US008194107B2

(12) United States Patent
Lyons et al.

(10) Patent No.: US 8,194,107 B2
(45) **Date of Patent: *Jun. 5, 2012**

(54) TWO-SIDED THERMAL PRINT COMMAND

(75) Inventors: Dale Lyons, Suwanee, GA (US); Justin Collins, Gillsville, GA (US); Michael VanDemark, Springboro, OH (US); Sachio Koyama, Singapore (JP)

(73) Assignee: NCR Corporation, Duluth, GA (US)

( * ) Notice: Subject to any disclaimer, the term of this patent is extended or adjusted under 35 U.S.C. 154(b) by 1401 days.

This patent is subject to a terminal disclaimer.

(21) Appl. No.: 11/757,529

(22) Filed: Jun. 4, 2007

(65) Prior Publication Data

US 2008/0297583 A1 Dec. 4, 2008

(51) Int. Cl.
*B41J 2/315* (2006.01)
*B41J 2/32* (2006.01)

(52) U.S. Cl. ..... 347/171

(58) Field of Classification Search ..... 347/186, 347/211, 221, 171–178, 213, 215
See application file for complete search history.

(56) References Cited

U.S. PATENT DOCUMENTS

| | | | |
|---|---|---|---|
| 3,947,854 | A | 3/1976 | Hansen et al. |
| 4,167,392 | A | 9/1979 | Defago |
| RE30,116 | E | 10/1979 | Maalouf |
| 4,309,255 | A | 1/1982 | Gendler et al. |
| 4,507,669 | A | 3/1985 | Sakamoto et al. |
| 4,708,500 | A | 11/1987 | Bangs et al. |
| 4,956,251 | A | 9/1990 | Washizu et al. |
| 4,965,166 | A | 10/1990 | Hosoi et al. |
| 5,055,373 | A | 10/1991 | Saeki et al. |
| 5,101,222 | A | 3/1992 | Hakkaku |
| 5,132,704 | A | 7/1992 | Nakagawa |
| 5,196,297 | A | 3/1993 | Dombrowski, Jr. et al. |
| 5,214,750 | A | 5/1993 | Minowa et al. |
| 5,266,550 | A | 11/1993 | Asajima et al. |
| 5,284,816 | A | 2/1994 | Stephenson |
| 5,398,305 | A | 3/1995 | Yawata et al. |
| 5,428,714 | A | 6/1995 | Yawata et al. |
| 5,437,004 | A | 7/1995 | Miyasaka et al. |
| 5,555,349 | A | 9/1996 | Miyasaka et al. |
| 5,584,590 | A | 12/1996 | Ito et al. |
| 5,594,653 | A | 1/1997 | Akiyama et al. |
| 5,629,259 | A | 5/1997 | Akada et al. |

(Continued)

FOREIGN PATENT DOCUMENTS

EP 0947340 10/1999

(Continued)

OTHER PUBLICATIONS

JP Abstract, vol. 007, No. 063 (M-200), Mar. 16, 1983 & JP 57-208298 A (Ricoh KK), Dec. 21, 1982.

(Continued)

*Primary Examiner* — Hai C Pham
(74) *Attorney, Agent, or Firm* — NCR Corporation

(57) ABSTRACT

In an embodiment, a method of operating a dual-sided direct thermal printer comprising a first thermal print head on a first side of a media feed path and a second thermal print head on a second side of the media feed path opposite the first side is provided, wherein the method comprises receiving a select thermal printing mode command and operating the dual-sided direct thermal printer according to the received select thermal printing mode command.

52 Claims, 13 Drawing Sheets

U.S. PATENT DOCUMENTS

| | | | | |
|---|---|---|---|---|
| 5,639,169 | A | 6/1997 | Aruga | |
| 5,648,800 | A * | 7/1997 | Takeda | 346/45 |
| 5,667,303 | A | 9/1997 | Arens et al. | |
| 5,677,722 | A | 10/1997 | Park | |
| 5,692,110 | A | 11/1997 | Miyasaka et al. | |
| 5,707,925 | A | 1/1998 | Akada et al. | |
| 5,710,094 | A | 1/1998 | Minami et al. | |
| 5,755,521 | A | 5/1998 | Ito et al. | |
| 5,756,188 | A | 5/1998 | Reiter et al. | |
| 5,763,356 | A | 6/1998 | Ueno et al. | |
| 5,789,340 | A | 8/1998 | Brust et al. | |
| 5,792,725 | A | 8/1998 | Simpson et al. | |
| 5,794,530 | A | 8/1998 | Dobashi et al. | |
| 5,800,081 | A | 9/1998 | Teradaira et al. | |
| 5,815,191 | A | 9/1998 | Michielsen et al. | |
| 5,846,900 | A | 12/1998 | Reiter et al. | |
| 5,876,836 | A | 3/1999 | Imamura et al. | |
| 5,883,043 | A | 3/1999 | Halbrook, Jr. et al. | |
| 5,886,725 | A | 3/1999 | Miyadera et al. | |
| 5,918,910 | A | 7/1999 | Stillwagon et al. | |
| 5,964,541 | A | 10/1999 | Murison et al. | |
| 6,095,414 | A | 8/2000 | Long et al. | |
| 6,130,185 | A | 10/2000 | Narita et al. | |
| 6,150,067 | A | 11/2000 | Koike et al. | |
| 6,210,777 | B1 | 4/2001 | Vermeulen et al. | |
| 6,233,057 | B1 * | 5/2001 | Ota | 358/1.13 |
| 6,388,692 | B1 | 5/2002 | Iwata et al. | |
| 6,524,000 | B1 | 2/2003 | Roth | |
| 6,544,925 | B1 | 4/2003 | Prusik et al. | |
| 6,562,755 | B1 | 5/2003 | Halbrook, Jr. et al. | |
| 6,759,366 | B2 | 7/2004 | Beckerdite et al. | |
| 6,784,906 | B2 | 8/2004 | Long et al. | |
| 6,801,233 | B2 | 10/2004 | Bhatt et al. | |
| 6,906,735 | B2 | 6/2005 | Bhatt et al. | |
| 7,360,887 | B2 * | 4/2008 | Konno | 347/103 |
| 7,671,878 | B2 * | 3/2010 | Yamada et al. | 347/171 |
| 2004/0084631 | A1 | 5/2004 | Spoonhower et al. | |
| 2005/0020387 | A1 | 1/2005 | Kennedy, III | |
| 2005/0164881 | A1 | 7/2005 | Kenney et al. | |
| 2006/0289633 | A1 | 12/2006 | Moreland et al. | |
| 2007/0211099 | A1 * | 9/2007 | Lyons et al. | 347/16 |
| 2007/0273746 | A1 * | 11/2007 | Holzschuh et al. | 347/220 |

FOREIGN PATENT DOCUMENTS

| | | |
|---|---|---|
| GB | 2250478 | 6/1992 |
| WO | WO 2004/077001 A1 | 9/2004 |

OTHER PUBLICATIONS

JP Abstract, vol. 007, No. 081 (M-105), Apr. 5, 1983 & JP 58-008668 A (Shinko Denki KK), Jan. 18, 1983.

JP Abstract, Vo. 015, No. 194 (M-1114), May 20, 1991 & JP 03-051149 A (Fujitsu General Ltd.), Mar. 5, 1991.

JP Abstract, vol. 2000, No. 24 May 11, 2001 & JP 2001-199095 A (Alps Electric Co. Ltd.), Jul. 24, 2001.

JP Abstract, vol. 1998, No. 08, Jun. 30, 1998 & JP 10-076713 A (Sony Corp.) Mar. 24, 1998.

JP Abstract, vol. 010, No. 151 (M-483), May 31, 1986 & JP 61-003765 A (Konishiroku Shashin Kogyo KK), Jan. 9, 1986.

JP Abstract, vol. 016, No. 041 (M-1206), Jan. 31, 1992 & JP 03-246091 A (Canon Inc.), Nov. 1, 1991.

Boca Systems Micro Plus 2S 2 Sided Printer product brochure which came to the attention of Applicant at a Chicago tradeshow during the summer of 2002.

APTi PowerEcoT R2412 printer brochure, which was came to the attention of Applicant in the summer of 2007, and was translated by Applicant's Japanese Office in the fall of 2007.

* cited by examiner

TWO-SIDED THERMAL PRINT COMMAND

CROSS REFERENCE TO RELATED APPLICATIONS

This application claims priority to U.S. Provisional Application No. 60/779,781 entitled "Two-Sided Thermal Printing" and filed on Mar. 7, 2006, U.S. Provisional Application No. 60/779,782 entitled "Dual-Sided Thermal Printer" and filed on Mar. 7, 2006, U.S. application Ser. No. 11/297,706 entitled "Dual-Sided Thermal Printing" and filed on Dec. 8, 2005, U.S. application Ser. No. 11/644,262 entitled "Two-Sided Thermal Print Sensing" and filed on Dec. 22, 2006, U.S. application Ser. No. 11/675,649 entitled "Two-Sided Thermal Print Switch" and filed on Feb. 16, 2007, and U.S. application Ser. No. 11/678,216 entitled "Two-Sided Thermal Print Configurations" and filed on Feb. 23, 2007, the disclosures of which are hereby incorporated by reference herein.

BACKGROUND

Two, or dual-sided direct thermal printing of documents such as transaction documents and receipts is described in U.S. Pat. Nos. 6,784,906 and 6,759,366. In dual-sided direct thermal printing, the printers are configured to allow concurrent printing on both sides of thermal media moving along a feed path through the printer. In such printers a direct thermal print head is disposed on each side of the media along the feed path. In operation each thermal print head faces an opposing platen across the media from the respective print head.

In direct thermal printing, a print head selectively applies heat to paper or other sheet media comprising a substrate with a thermally sensitive coating. The coating changes color when heat is applied, by which "printing" is provided on the coated substrate. For dual-sided direct thermal printing, the sheet media substrate may be coated on both sides.

SUMMARY

A dual-sided direct thermal printer may be configured to allow printing on both sides of a paper receipt, document, label or other thermal media moving along a feed path through the printer. In various embodiments, dual-sided printer operation may be controlled using commands in the form of, for example, setup configuration settings in hardware or software, escape sequences, real-time printer commands, and the like.

In one embodiment, a method of operating a dual-sided direct thermal printer comprising a first thermal print head on a first side of a media feed path and a second thermal print head on a second side of the media feed path opposite the first side is provided, the method comprising: receiving a select thermal printing mode command directing operation of the dual-sided direct thermal printer in one of (i) a single-sided printing mode wherein the dual-sided direct thermal printer is operative to print data using only one of the first and the second thermal print heads, and (ii) a dual-sided printing mode wherein the dual-sided direct thermal printer is operative to print data using both the first and the second thermal print heads; and operating the dual-sided direct thermal printer according to the received select thermal printing mode command.

In a further embodiment, a dual-sided direct thermal printer is provided, the printer comprising: a first thermal print head on a first side of a media feed path; a second thermal print head on a second side of the media feed path opposite the first side; a communication controller adapted to receive a select thermal printing mode command directing operation of the dual-sided direct thermal printer in one of (i) a single-sided printing mode wherein the dual-sided direct thermal printer is operative to print data using only one of the first and the second thermal print heads, and (ii) a dual-sided printing mode wherein the dual-sided direct thermal printer is operative to print data using both the first and the second thermal print heads; and a printing function switch adapted to operate the dual-sided direct thermal printer according to the received select thermal printing mode command.

Dual-sided direct thermal printing provides for printing of variable information on both sides of a print media, such as a receipt, to save materials, and to provide flexibility in providing information to customers. The printing can be driven electronically or by computer using a computer application program which directs dual-sided printing.

DETAILED DESCRIPTION

By way of example, various embodiments of the invention are described in the material to follow with reference to the included drawings. Variations may be adopted.

Figure 1:
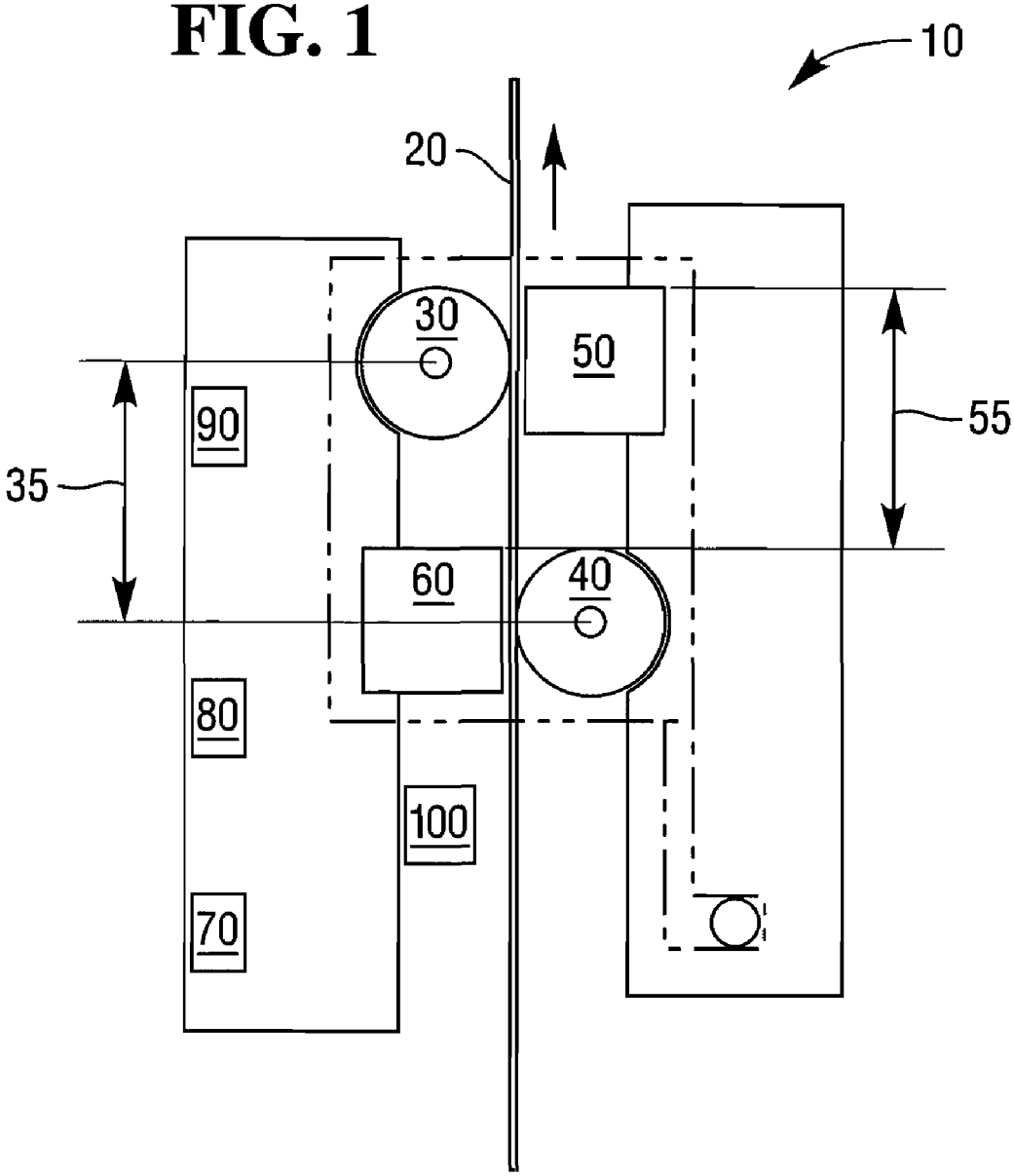
FIG. 1 shows a schematic of a dual-sided imaging direct thermal printer useable for dual-sided printing of thermal media such as transaction receipts or tickets.

FIG. 1 shows a schematic of a dual-sided imaging direct thermal printer 10 useable for dual-sided printing of, for example, transaction receipts or tickets at time of issue. The printer 10 operates on print media 20 comprising, for example, double-sided thermal paper, e.g., comprising a cellulosic or polymer substrate sheet coated on each side with heat sensitive dyes as described in U.S. Pat. Nos. 6,784,906 and 6,759,366 the contents of which are hereby incorporated herein by reference. Substrates and heat sensitive color changing coatings for direct thermal printing media are generally well known in the art.

Dual-sided direct thermal printing can be facilitated by a media 20 which includes dyes on opposite sides of the media 20, and a sufficiently thermally resistant substrate to inhibit thermal printing on one side of the media 20 from affecting coloration on the opposite side of the media 20.

The thermal print media 20 may be supplied in the form of a paper roll, fan-fold stack, individual sheet and the like, upon which printing such as graphics or text, or both, may be printed on one or both sides of the media 20, to provide, for example, a voucher, coupon, receipt, ticket or other article or document.

As shown in FIG. 1, a printer 10 may have rotating platens 30 and 40 and opposing thermal print heads 50 and 60 on opposite sides of the thermal media 20. Dual-sided direct thermal printing of the media 20 may occur in a single pass at, for example, completion of a transaction such as when a receipt or ticket is issued. Alternately, dual-sided direct thermal printing may occur in a two or more pass process where, for example, installed media 20 is imaged by one or both thermal print heads 50 and 60 when moving in a first direction, and then retracted for further imaging by one or both thermal print heads 50 and 60 with the media 20 moving in either the first or a second, retract direction. Once printing is completed the media 20 may, depending on its format (e.g., roll, fan fold, individual sheets, and the like), be manually or automatically cut or severed to provide an individual receipt, ticket, or other document.

A dual-sided imaging direct thermal printer 10 may further include a switch 70 enabling activation and deactivation of one or more dual-sided printing modes or functions. Such dual-sided printing function switch 70 can be a mechanically operated switch in or on the printer 10, or an electronically operated switch operated by a printer driver on an associated host computer or by firmware or software resident on the printer 10, and the like. The switch 70 may, for example, be electronically operated in response to a command message or escape sequence transmitted to the printer 10. Printer control language or printer job language ("PCL/PJL"), or escape commands, and the like, may be used. A printer setup configuration program setting, e.g., a setting made through a software controlled utility page implemented on an associated host computer, could also electronically operate a function switch 70 of a dual-sided printer 10.

Various commands, including ASCII, decimal, hexadecimal and like commands, may be transmitted to a dual-sided direct thermal printer, such as the printer 10 of FIG. 1, to set functionality and/or otherwise control operation of the dual-sided direct thermal printer. As described further hereinbelow, such commands may include: (1) a select thermal printing mode command for setting a mode of printer operation (e.g., single-sided mode, double-sided mode with single-side command, double-sided mode with double-side command, and/or double-sided mode with predefined data), (2) a printer setting change command for storing a print setting change, (3) a printer print data command for initiating printing, (4) a select thermal printing side command for setting a side of print media (e.g., front or back) on which to print various data, (5) a select or cancel upside-down printing for double-side mode command for selecting orientation of print on a front and/or back media side, (6) a swap front side and back side command for printing data targeted for printing on a front side on a back side, and vice versa, (7) a download predefined message into buffer command for downloading predefined print data into printer memory, (8) an enable predefined bottom/top message command for printing a predefined message on the bottom of a front and/or top of a back media side, (9) a select nth macro command for selecting a predefined data block for printing, (10) a start or end predefined back side printing command for starting or ending printing of predefined data on a back side of thermal media, and (11) a define minimum receipt length command for converting from one-sided to two-sided thermal printing. In addition to the receipt of such commands, two-sided thermal printer functionality and/or operation may be set or otherwise selected through manual entry of print set-up commands via one or more manual inputs, such as one or more buttons or switches, associated with a dual-sided direct thermal printer, such as the printer 10 of FIG. 1.

In one embodiment, a dual-sided printing function switch 70 may be configured, programmed or otherwise setup to select or otherwise identify (1) data for printing (e.g., internally stored macros, externally received transaction data, and the like), (2) which of the available thermal print heads 50 and 60 will be used to print and/or be used to print particular data, (3) whether selected data is to be printed when the media is moving in a first (e.g., forward) or second (e.g., backward) direction, (4) in which relative and/or absolute media location, including on which media side, particular data will be printed, (5) in which orientation (e.g., rightside-up, upside-down, angled, and the like) particular data will be printed on media 20, and the like. For example, a setting of the dual-sided printing function switch 70 may marshal a portion (e.g., a first half) of a block of selected externally received and/or internally stored print data to be printed on a first (e.g., front) side of media 20 and another portion (e.g., a second half) to be printed on a second (e.g., reverse) side of the media 20. A further setting may reverse the media sides on which the respective portions of data are to be printed. In this manner a document such as a transaction receipt may be generated in which a portion of the associated transaction data is printed on one side of the receipt and the remaining portion of the transaction data is printed on the other side of the receipt, conserving upon the amount of media 20 required for printing of the receipt. A dual-sided printing function switch 70 may be accordingly configured, e.g., by manual switch setting and/or through use of one or more control command messages transmitted to the printer 10, to determine, inter alia, the portion or quantity of data, or a block of data, to be printed on each side of the media. Different blocks of data, or portions thereof, may be alternatively selected and marshaled to different sides, or locations thereon, of the media 20 by the switch 70 according to the received command messages.

In one embodiment, a printing function switch 70 may select a first portion of print data for printing on a first side of thermal media 20, such as a receipt paper roll, and a second portion of print data for printing on a second side of the thermal media 20. Such print data may comprise data contemporaneously received by the printer 10 from a host computer such as a point-of-sale (POS) terminal (not shown), an automated teller machine (ATM) (not shown), a self-checkout system (not shown), and the like, and/or data stored in one or more memory or buffer locations 80 in the printer 10. It should be noted that print data may be (1) processed for printing before receipt by or storage in the printer 10 by, for example, a host computer such as a POS terminal, (2) processed for printing after receipt by or storage in the printer 10 by, for example, the printing function switch 70, or a controller or processor 90 associated with the printer 10, or (3) a combination of (1) and (2), among others. Likewise, such processing may occur before or after selection, identification and/or apportionment of the print data for printing on the first and/or second side of thermal media 20 by the printing function switch 70.

In another embodiment, a printing function switch 70 may be configured to select or otherwise identify print data for printing at a specified location, including a side, of the print media 20 based upon a quantity of media required to print such data. Such quantity may be determined based on, inter alia, (1) a physical, as-printed size (e.g., length, width, perimeter, area, font size, and the like) of the to-be-printed data, (2) a portion of the media 20 that is thermally imageable (e.g., a portion having one or more thermally sensitive coatings), (3) a portion of the media 20 which is pre-printed or pre-imaged, (4) a portion of the media 20 which is excluded or desired to be excluded from thermal or other imaging (e.g., margins, headers, line spacings, indentations, desired or required blank space, and the like), (5) physical characteristics of the printer 10 (e.g., size of the platens 30 and 40, size of the thermal print heads 50 and 60, spacing 35 of the platens 30 and 40, spacing 55 of the thermal print heads 50 and 60, and the like), and the like.

In an embodiment, a printing function switch 70 may apportion a first portion of print data for printing on a first side of media 20 and a second portion of print data for printing on a second side of the media 20, wherein the first and second portions are selected to occupy substantially the same amount of space on the respective first and second media sides when printed. Likewise, the printing function switch may apportion a first portion of print data for printing on a first side of the media 20 and a second portion of print data for printing on a second side of the media 20, opposite the first side, wherein the as-printed size of the first portion is selected to be greater than the as-printed size of the second portion. Differences in the as-printed size of the first and second data portions may be selected to accommodate, inter alia, (1) differences in an amount of printable space (e.g., accounting for margins, headers, footers, preprinted information, thermal coating coverage, and the like) between the first and the second sides of the media 20, (2) differences in the type of data (e.g., internally stored macro versus externally received transaction, and the like) selected for printing on a given side, and (3) differences in thermal print head location on the first and the second sides of the media 20 (e.g., print head space 55).

In one embodiment, the printing function switch 70 may apportion a first portion of print data, such as ticket information, for printing on a first side of the media 20 and a second portion of print data, such as a legal information, for printing on a second side of the media 20, opposite the first side, wherein the as-printed size (e.g., printed area) of the first portion is selected to be greater than the as-printed size (e.g., printed area) of the second portion by an amount substantially equivalent to an amount of printable space (e.g., area) on the second side of the media 20 between the thermal print heads 50 and 60. It should be noted that the as-printed size of the print data on a given side may be controlled by selection of an amount of data to be printed on a given side, selection of a size at which selected data is to be printed (e.g., font, font size, and/or data scaling), and the like.

In a further embodiment, apportionment of print data may be made by a printing function switch 70 such that a length of media 20 along a media feed path (e.g., following the arrow at the top of FIG. 1) to be occupied by print data on a first side of the media 20 differs from a length of the media 20 along the media feed path to be occupied by print data on a second side of the media 20, by a length substantially equivalent to a spacing 35 between platens 30 and 40, a length substantially equivalent to a spacing 55 between the thermal print heads 50 and 60, and the like.

In one such case, first and second portions of data received by a printer 10, such as POS transaction data, may be identified by the printing function switch 70 such that a length of a first side of print media 20, such as a receipt, to be occupied by the first portion of the print data is greater than a length of a second side of the print media 20 to be occupied by the second portion of the print data by a length substantially equivalent to a spacing 55 between the first and the second thermal print heads 50 and 60. Other relevant lengths and/or variations in the apportionment of print data are, of course, possible. Additionally, the received print data may be stored in one or more buffers 80 of the printer 10 before or after identification by the printing function switch 70 for printing on one or both sides of the media 20.

In another embodiment, data selected or otherwise identified for printing on one or both sides of media 20 by the printing function switch 70 may include predefined print data or macros, such as one or more of a location identifier (e.g., address), an establishment identifier (e.g., store), a computer identifier (e.g., POS terminal), a logo, an advertisement, and the like, stored in one or more memories associated with the printer 10. In one example, some or all of such predefined print data may be selected for printing in the space 55 between the first and the second thermal print heads 50 and 60 on one or both sides of the media 20. Further, such information may be selected for printing in advance of any contemporaneously received print data, such as transaction data received from a POS terminal, which is to be included on, for example, the same document or receipt. Likewise, predefined print data may be selected for printing on regions of the media 20 where it may otherwise be difficult or undesirable for printing of contemporaneous information to occur, such as a region of media 20 between the first and second thermal print heads 50 and 60, thereby maximizing use of the media 20.

In a further embodiment, the printing function switch 70 may apportion print data, including, inter alia, internally stored macros and/or received transaction data, among a first and a second side of the thermal media 20 in order to optimize use of the media. In performing such optimization, the printing function switch may control the as-printed size (e.g., font, font size, scaling, and the like) of selected print data. Likewise, the printing function switch 70 may take account of, inter alia, (1) media size and design parameters including desired or required headers, footers, margins, and the like, (2) thermally sensitive coating location(s), and (3) any information that may be preprinted on the media 20 in making apportionment and/or sizing decisions. In one embodiment, such accounting may comprise the printing function switch 70 avoiding apportionment of some or all of the selected print data to certain media regions, such as regions where preprinted data exists, apportioning some or all of the selected print data to certain media regions, such as regions set off by one or more sensemarks or other preprinted data, changing a type face and/or size to fit the selected print data in a particular media region, and the like. Further, in some embodiments, one or more sensors 100, such as one or more optical sensors, may be used to sense regions of preprinted information and/or regions demarked by one or more sensemarks for making apportionment and non-apportionment decisions as part of such print media use optimization.

Figure 2:
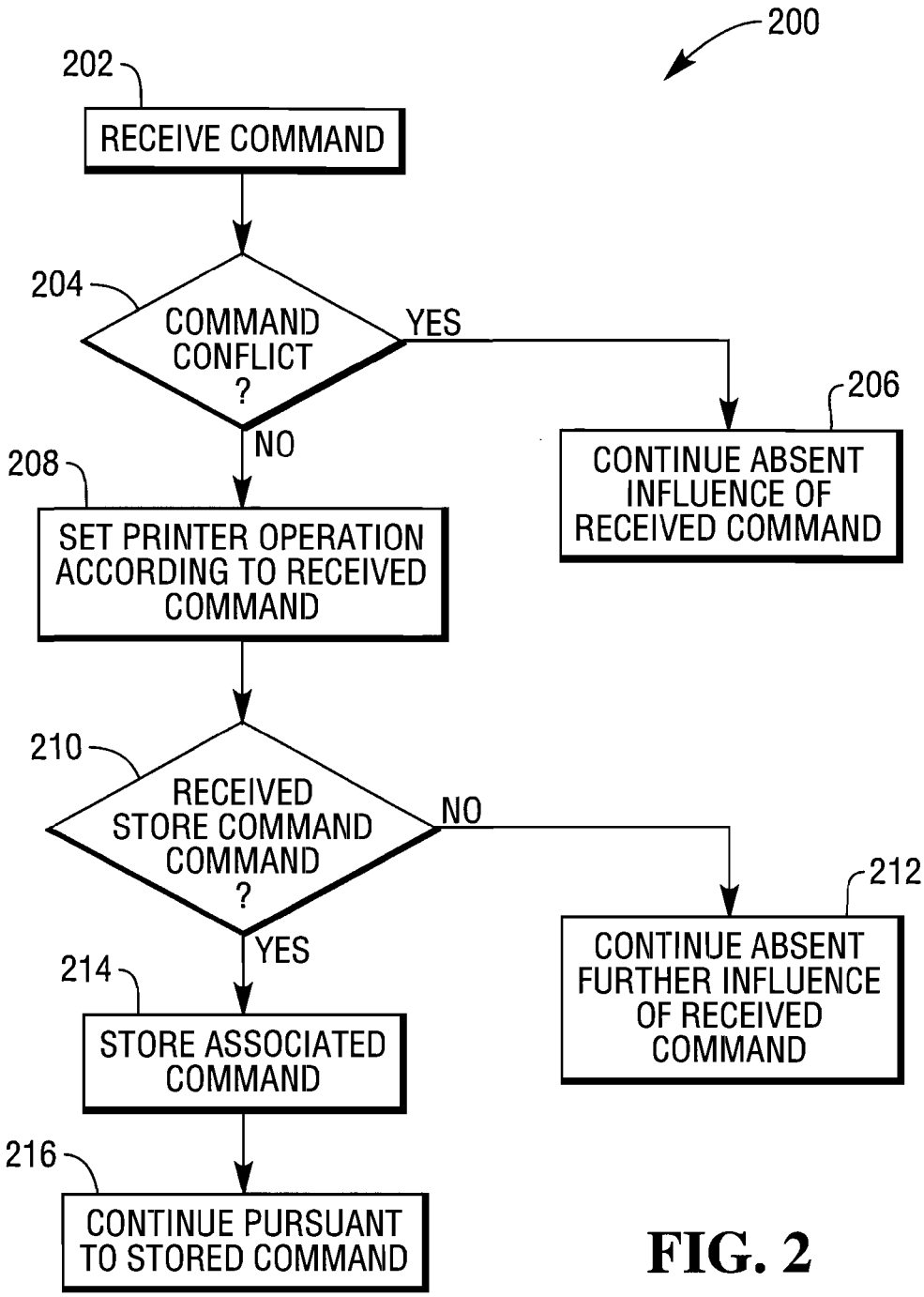
FIG. 2 shows a method of operating a dual-sided imaging direct thermal printer.

Functionality and/or operation of a dual-sided imaging direct thermal printer may be set or otherwise selected through use of one or more print commands. In one embodiment, FIG. 2 shows a method 200 of operating of a dual-sided imaging direct thermal printer, such as the printer 10 of FIG. 1. At step 202, the dual-sided imaging direct thermal printer receives a command directing printer functionality and/or operation, which command may be received with accompanying print data. Additionally, such command may be received through use oft for example, a communication controller 96 associated with the dual-sided imaging direct thermal printer 10 as shown in FIG. 1. As further described herein, a received command may comprise, inter alia, a select thermal printing mode command (e.g., a hexadecimal 1F 60 n command) for setting a dual-sided imaging direct thermal printer operating mode to one of a single-sided mode, a double-sided with single-side command mode, a double-sided with double-side command mode, and a double-sided with predefined data command mode (e.g., a upon receipt of a hexadecimal 1F 61 00, 1F 61 01, 1F 61 02, and 1F 61 03 command, respectively).

As shown in step 204 of FIG. 2, a command received at step 202 may be compared with one or more additional print settings and/or commands, including default values thereof, to determine if a command conflict exists. If one or more conflicts exist, in step 206 printer operation may continue absent influence of the received command (e.g., the received command may be ignored). If however, no conflicts are found to exist, printer operation may be set or otherwise occur according to the received command in step 208. In one embodiment, a first received command, such as a select thermal printing side command (e.g., a hexadecimal 1F 61 n command), may execute or otherwise influence printer operation only when a second command or setting, such as a select thermal printing mode command (e.g., a hexadecimal 1F 60 n command), comprises a particular command or value, such as a double-sided with double-side command mode command (e.g., a hexadecimal 1F 60 2 command) command. In some embodiments, the step 208 of setting printer operation and/or functionality may comprise setting configuration, operation and/or functionality of a printing function switch, such as the switch 70 associated with the printer 10 of FIG. 1. Such configuration, operation and/or functionality may be manually and/or automatically set through use of, for example, one or more electromechanical switches, and/or one or more processors and memories for executing and storing associated control software and related settings, and the like.

At step 210 of FIG. 2, in some embodiments, a separate command, such as a printer setting change command (e.g., a hexadecimal 1FH 11H command), may be required to be received before an associated command, such as a prior or contemporaneously received printer command, is stored as a current printer setting. Such storage may occur in, for example, one or more memory or buffer elements 80 associated with a dual-sided imaging direct thermal printer 10 as shown in FIG. 1. Where so stored, such command may remain current until a further command is received and/or stored to override it.

In one embodiment, receipt of a printer setting change command (e.g., a hexadecimal 1FH 11H command) may be required prior to storing an associated command such as a select thermal printing mode command (e.g., a hexadecimal 1F 60 n command) in a memory 80 of a dual-sided imaging direct thermal printer 10. Where such a storage command is required but not received, operation of a dual-sided imaging direct thermal printer may continue absent influence and/or further influence of such associated command, as shown in step 212 of FIG. 2. Likewise, where such a storage command is required and received, an associated command may be stored as, for example, a default setting for use in subsequent printer operation, as shown in step 216 of FIG. 2.

Where not otherwise defined through, for example, receipt of a specific command as shown in step 202 of FIG. 2, a given printer function and/or operating mode may be set according to one or more predefined, default functions or operating modes. For example, in one embodiment, a dual-sided imaging direct thermal printer may default to operation in a single side mode (e.g., according to a hexadecimal 1F 60 00 command) in lieu of any received alternative thermal printing mode command (e.g., a hexadecimal 1F 60 01, IF 60 02, or 1F 60 03 command). In other embodiments, dual-sided imaging direct thermal printer functionality and/or operation may be set or otherwise defined based on one or more printer conditions, such as automatic initiation of printing by one or both of a first and a second thermal print head when received print data exceeds a print buffer storage capacity, and the like.

Figure 3A:
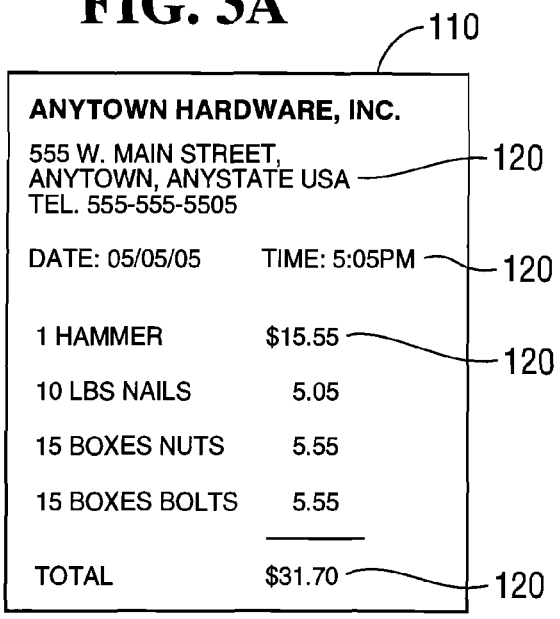
FIG. 3A shows a two-sided receipt with transaction detail printed on the front side.
Figure 3B:
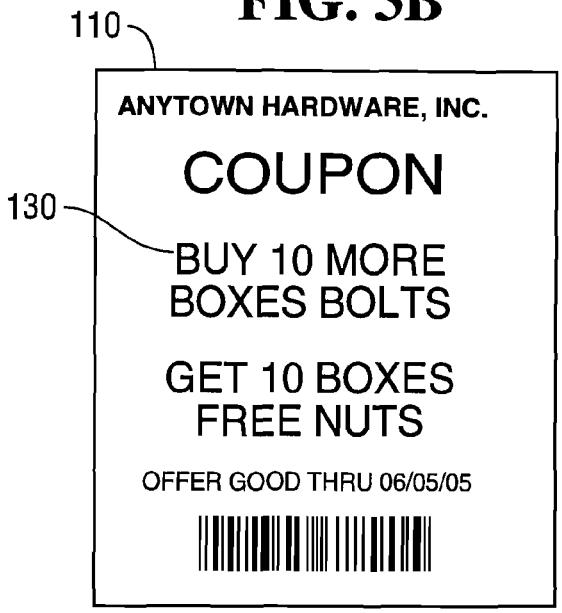
FIG. 3B shows the receipt of FIG. 3A with supplemental information printed on the reverse side, such as variable stored information selected on the basis of the transaction detail.

FIG. 3A shows a two-sided thermal document in the form of a receipt 110 having transaction detail 120 such as issuer identification, time, date, line item entries and a transaction total printed on a first (front) side of the receipt 110. FIG. 3B shows custom information 130 printed on a second (back) side of the receipt 110 contemporaneous with the transaction detail information 120 printed on the front. For example, the custom information 130 could include further or duplicate transaction information, a coupon (as shown), rebate or contest information, serialized cartoons, conditions of sale, document images, advertisements, security features, ticket information, legal information such as disclaimers, warranties and the like, or other information. Further, the custom information 130 may be targeted based on recipient/purchaser identity, transaction data, transaction detail 120, store inventory or specials, manufacturer inventory or specials, and the like, or randomly selected from a database of possible options, among other means.

Figure 3C:
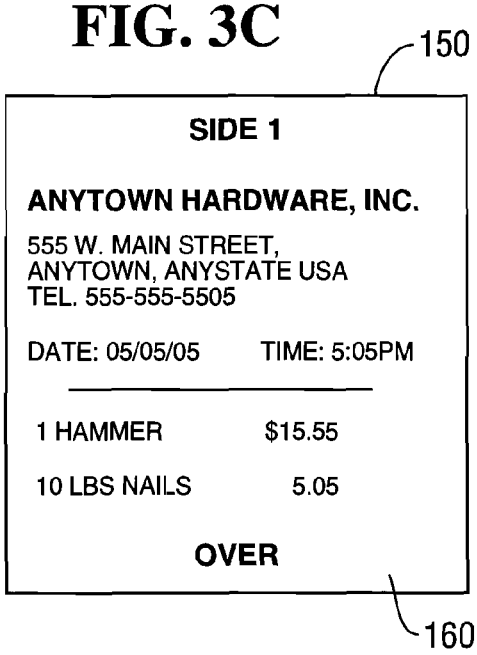
FIG. 3C shows a two-sided receipt with a portion of the associated transaction detail printed on the front side of the receipt.
Figure 3D:
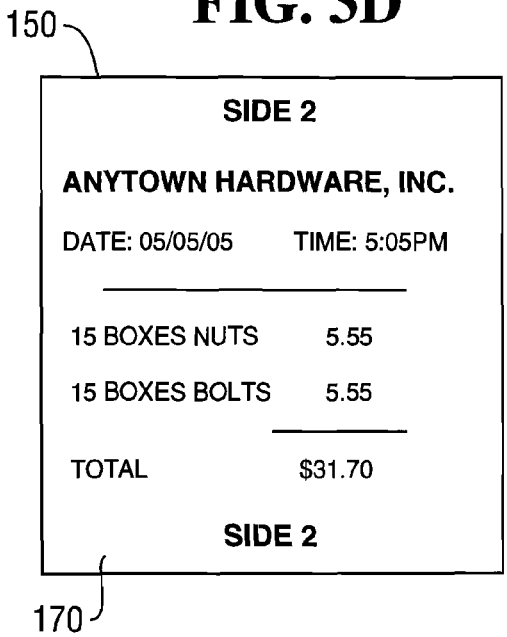
FIG. 3D shows the reverse side of the receipt of FIG. 3C on which the remaining portion of the associated transaction data is printed.

FIG. 3C shows a two-sided receipt 150 with a portion of the associated transaction detail printed on the front side 160 of the receipt 150. FIG. 3D shows the reverse side 170 of the receipt 150 shown in FIG. 3C, where the remaining portion of the associated transaction data is shown printed on the reverse side 170 of the receipt 150. Indicia such as "Front Side," "Reverse Side," "Side 1," "Side 2," or the like may be included on the two sides 160 and 170 of the receipt 150 (as shown) to denote the two-sided nature of the receipt 150 or the respective side 160 and 170 of the receipt 150 being viewed. Identifying indicia such as a receipt or transaction number, terminal number, store identifier, date, time or the like may also be printed on both sides 160 and 170 of the receipt 150 to enable ready identification of the receipt 150 from either side 160 and 170 and/or of copied images of the two sides 160 and 170.

Figure 4:
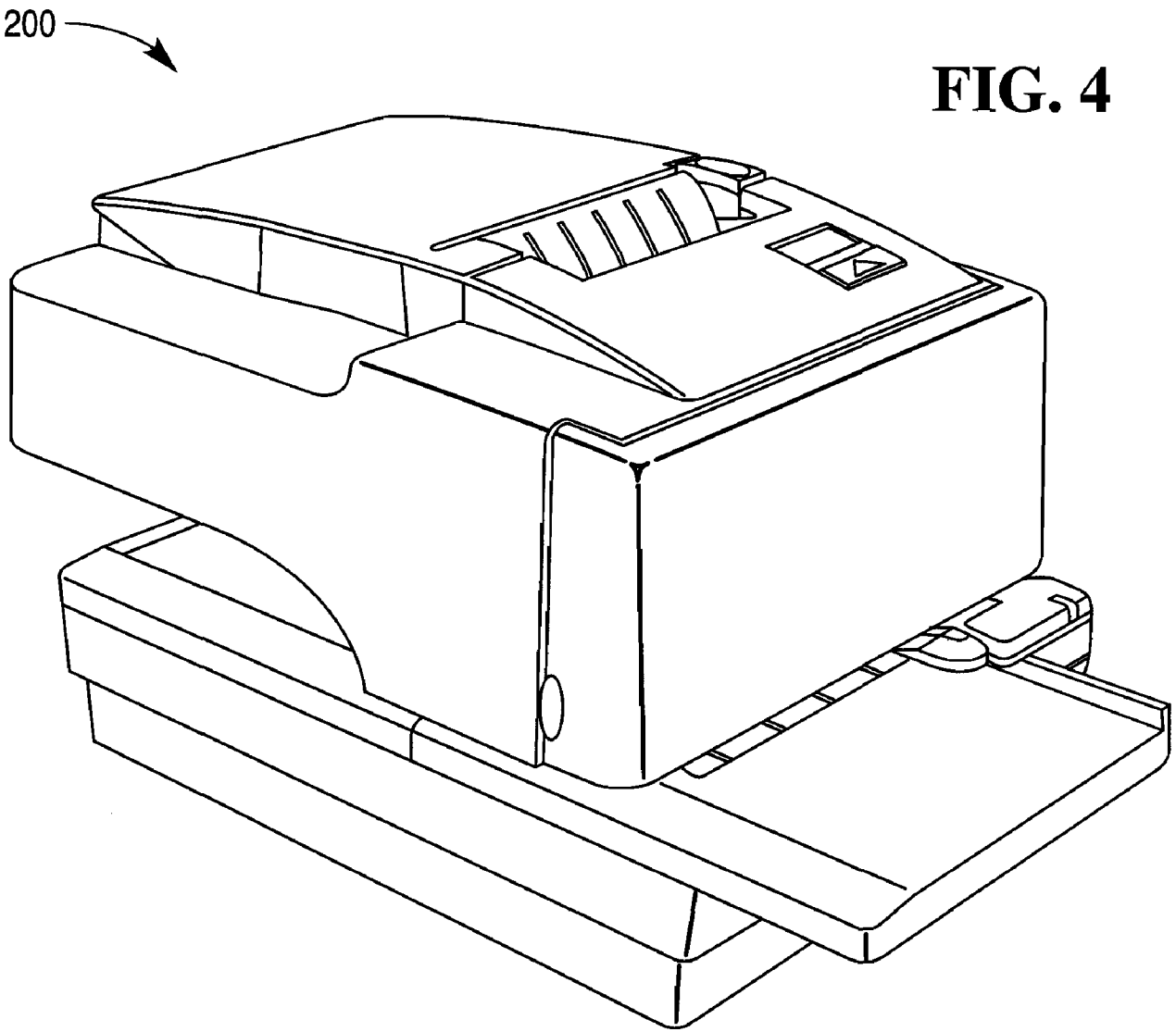
FIG. 4 shows a perspective view of an exemplary dual-sided direct thermal receipt printer for retail Point of Sale (POS) application.

FIG. 4 shows a perspective view of an exemplary dual-sided direct thermal receipt printer 200 for point-of-sale (POS) terminal application.

Figure 5:
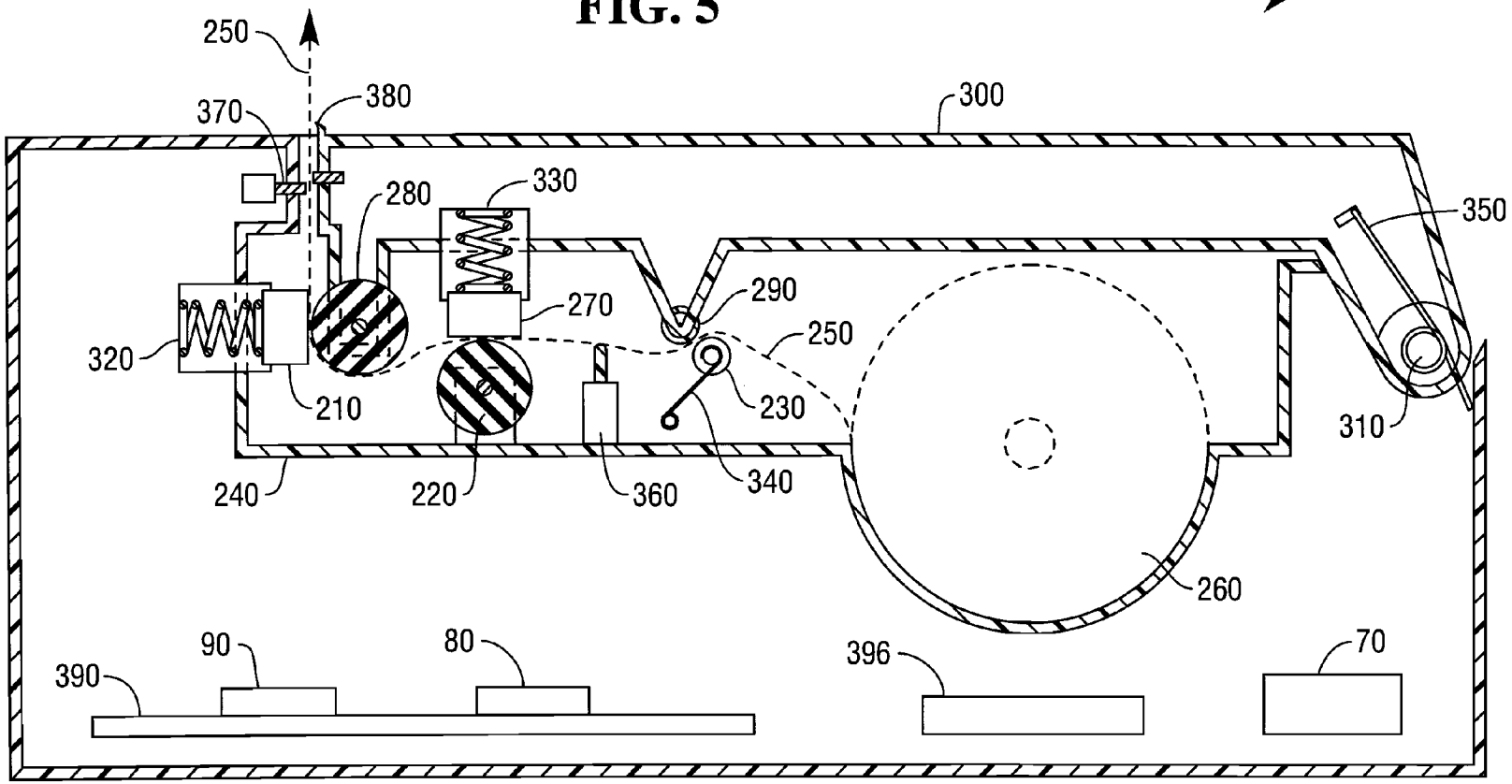
FIG. 5 schematically shows a partial centerline cross-sectional view of the dual-sided direct thermal receipt printer of FIG. 4.

FIG. 5 schematically shows a partial centerline elevation view of the dual-sided direct thermal receipt printer 200 of FIG. 4, in a closed (operating) position. As shown, the printer 200 includes a print head 210, a platen 220 and a guide roller 230 all coupled to a supporting arm or base structure 240. The print head 210, platen 220 and guide roller 230 are on one side of the feed path 250 of the dual-sided thermal print media taken off a supply roll 260. The printer 200 also includes a print head 270, a platen 280 and a guide roller 290 all coupled to a pivotable supporting arm or cover 300, which pivots about a hinge line 310 to allow, for example, paper replacement and servicing. When the arm 300 is in the closed position (as shown), the media paper may be engaged between the print head 210 and opposed platen 280, between the print head 270 and the opposed platen 220, and between the guide rollers 230 and 290. Contact pressures with, and tension of, the print media are maintained by, for example, spring loading of the various printer elements using springs 320, 330 and 340.

As further shown in FIG. 5, a printer 200 may further include a spring 350 for the pivotable supporting arm or cover 300 to enable opening of the cover 300 at a controlled rate, and thereby avoid, for example, uncontrolled closing of the cover 300 through force exerted on the cover 300 via the acceleration of gravity. A sensor 360, may further be provided to detects a paper out condition, and produce a signal which can be used to disable printing, notify a POS operator (not shown) to replace the supply roll 260, and the like. A sensor 360 may also be provided to identify regions of the media for printing, including identifying regions comprising sense marks or other preprinted material.

A printer 200 may also include an electronically activated mechanical cutting or knife blade mechanism 370 to sever the print media upon completion of a print task such as printing of a transaction receipt. A serrated edge 380 may also be included to enable manual severing of the print media at the end of a transaction, when a media print roll is replaced or reloaded, and the like.

As illustrated in FIG. 5, a printer 200 may also comprise control electronics for controlling operation of the printer 200. The control electronics may include a motherboard 390, a microprocessor or CPU 90, and memory 80, including one or more DRAM and/or NVRAM print buffer memory elements. The printer 200 further may comprise a communications controller 396 for communicating with one or more host or auxiliary systems such as a POS terminal (not shown) for input of data to, and output of data from, the printer 200. Communication controller 396 may support USB, Ethernet and/or wireless communications (e.g., 802.11, 802.15, and IR), among others. Data for printing would typically be supplied by a host POS terminal (not shown) communicating with the printer 200 via the communication controller 396. Supplemental data for printing, such as product and or discount coupon information can also be supplied by, for example, a network server (not shown) providing data directly to the printer 200 using the communication controller 396, or indirectly through the host POS terminal. The supplemental data for printing may vary depending upon the goods or services sold, an in-store, chain-wide or manufacturer special, identification of the customer, and/or one or more other transaction aspects.

The memory 80 of the dual-sided direct thermal printer 200 may have a predefined print data storage area to store one or more blocks of predefined print data to be repetitively printed on one or both sides of the print media. The blocks of predefined print data may comprise, for example, a store identifier, a logo, a coupon, an advertisement, and the like. The predefined print data may be printed along with data submitted by application software associated with the POS terminal (not shown) on the same or an opposite media side. Where multiple data blocks are stored in the predefined print data storage area, the blocks may be alternatively selected for printing through use of the hardware or software switch 70, as may be the location on or side of the media they are printed, and the like.

A dual-sided direct thermal printer 200 as described may be operated with legacy or other application program software developed for use with, for example, a single-sided direct thermal printer. In such case, the dual-sided logical or mechanical printing function switch 70 may be used to enable dual-sided thermal media printing using input from the single-sided application program software. A printing function switch 70 may enable and/or disable one or more dual-sided printing operations and/or functions in response to, inter alia, a manual setting, or to a command message or escape sequence transmitted to the printer 200 via the communication controller 396, or a configuration setting though a driver or utility interface as previously described.

In one example, the single-sided application software conventionally controls printing of submitted data on one media side, while the switch 70 enables printing of, for example, additional information on the opposite media side. This functioning would allow realization of dual-sided direct thermal printer benefits with legacy software, before or without having to invest in custom printing mode applications or other new application program or interface software.

A one-sided printing application program may thus control direct thermal printing on one side of a media sheet, where the dual-sided printing function switch 70 is configured to enable thermal printing on the other media side. The data printed under control of the function switch 70 may be a block of data stored in the memory 80 of the printer 200 for repetitive printing as previously described. The block of data to be printed may, for example, be selected by a received command or escape message, as a function of data received from the one-sided printing application program such as transaction detail data, or it may be randomly selected, as previously described.

By enabling printing on one side of a media sheet by a one-sided printing application program, and enabling printing on the opposite side of the sheet by operation of the function switch 70 activating and deactivating one or more dual-sided direct thermal printing functions, requirements for application program software may thus be simplified. Legacy or other application program software for one-sided printing which do not directly operate all dual-sided direct thermal printing functions may thus be used to print on one side of a media sheet. Stored, or other data received by, or available to the printer 200 may then be printed on the opposite side of the sheet media.

In another example, the dual-sided direct thermal printer 200 may be operated to print data provided by legacy or other application program software on both sides of a media sheet. In such case, the dual-sided logical or mechanical printing function switch 70 is used to enable a further mode of operation of the dual-sided thermal printer 200 to divide and apportion data received from the single-sided application program software among the two media sides. Such a split can be even, e.g., half of the data is printed on each side of the media, or can be otherwise apportioned to maximize use of the media in light of any preprinted material on or supplemental information to be printed with the single-sided application program provided data, and the like.

As a further option, the dual-sided thermal printer 200 may be designed to accommodate the ability to print on the front and back, or either side independently, of a thermal media.

Figure 6:
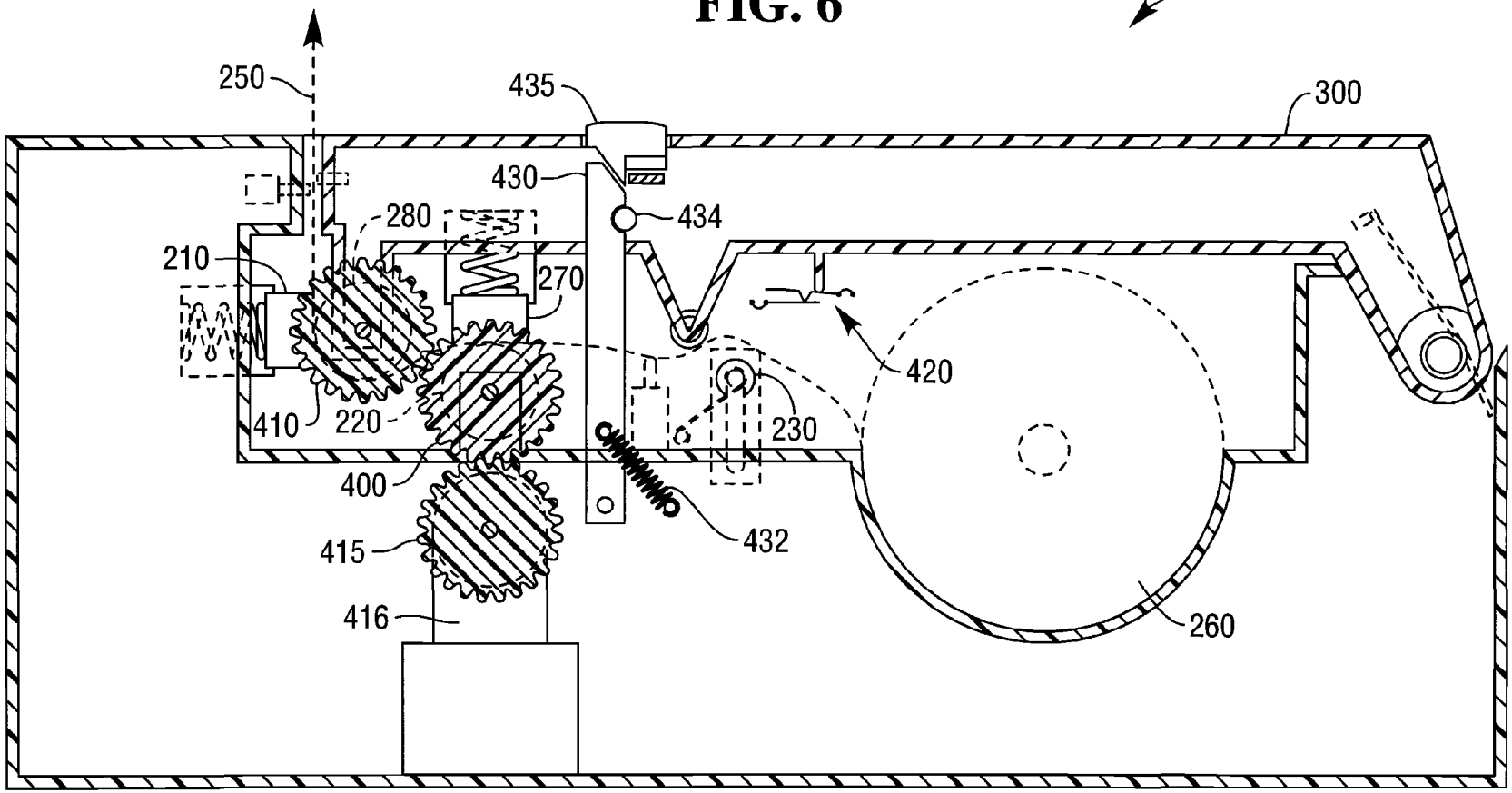
FIG. 6 schematically shows a partial gear plane cross-sectional view of the dual-sided direct thermal receipt printer of FIG. 4

FIG. 6 schematically shows an example partial drive or gear plane elevation view of the dual-sided direct thermal receipt printer 200 of FIGS. 4 and 5, with the cover 300 in a closed position. As shown, the platens 220 and 280 are coupled at their ends for rotation by a first gear 400 and a second gear 410, respectively. The first gear 400 is in operative contact with the second gear 410, as well as a third gear 415. The third gear 415 is coupled to a motor 416 for driving the first and second gears 400 and 410, and their respective platens 220 and 280. As shown, when rotated in a clockwise direction by the motor 416, the third gear 415 drives the first and second gears, 400 and 410, and their respective platens, 220 and 280, such that the print media is directed over the respective print heads away from the print roll 260 in a forward feed direction. Likewise, when rotated in a counterclockwise direction by the motor 416, the third gear 415 drives the first and second gears, 400 and 410, and their respective platens, 220 and 280, such that the print media is directed over the print heads toward to the print roll 260 in a backward feed or retract direction. Alternate motor and gear relations, as well as drive means (e.g., belt drives, direct drives, friction drives and the like), and rotations are, however, possible.

The printer 200 of FIG. 6 also includes one or more additional sensors, such as one or more limit switches 420, which provide signals for use in controlling operation, or signaling condition of the printer 200. For example, a signal from a first limit switch 420 can be used to notify a POS operator that the cover 300 of the printer 200 is not properly closed. Likewise, a signal from the first limit switch 420 can be used to allow automatic deactivation of printing until the cover 300 is in a properly closed position. Similarly, a signal from a second limit switch 420 can be used in combination with a signal from the first limit switch 420 to ensure the cover 300 is properly closed. This may include a determination that the cover 300 is properly aligned with respect to the base 240 such that opposing print heads (210 and 270) and platens (280 and 220) are in full and uniform contact across their width in advance of printing, and the like.

Additionally, a signal from a further sensor (not shown) may be used to indicate that a proper pressure for printing is obtained between opposing print heads and platens. Likewise, a further sensor (not shown) may be used to indicate a proper tension is obtained on the print media, or a locking mechanism such as one or more latch 430 is properly engaged. As for the limit switch 420, a signal from any such sensor may used to trigger notification of an improper condition to an operator (not shown), such as through the sending of an error message to a POS terminal (not shown), and/or through disabling some or all printer operations until the condition is corrected, and the like.

A locking mechanism, such as one or more latch or detent 430, is also provided with the printer 200 to secure the pivotable supporting arm 300 in place, and maintain the proper positioning of opposing print heads (210 and 270), platens (220 and 280) and guide rollers (230 and 290), including maintaining a proper contact pressure across the width of the media, and/or tension of the media along the media feed path 250 during printer operation. As shown, the latch 430 is biased by a spring 432 against a stop 434, and is released by pressing of a button 435. In addition to moving the latch 430 away from the stop 434, depression of the button 435 applies sufficient upward force on the cover 300 to separate the print heads from the platens in light of the applied contact pressure and frictional forces, and thereby allow the cover 300 to be freely opened.

The latch 430, in combination with the spring 350, also prevents the pivotable supporting arm 300 from striking the supporting arm or base structure 240, or other components of the printer 200 such as the print head 210, platen 220 and/or guide roller 230 if the pivotable supporting arm or cover 300 is opened and dropped.

Figure 7:
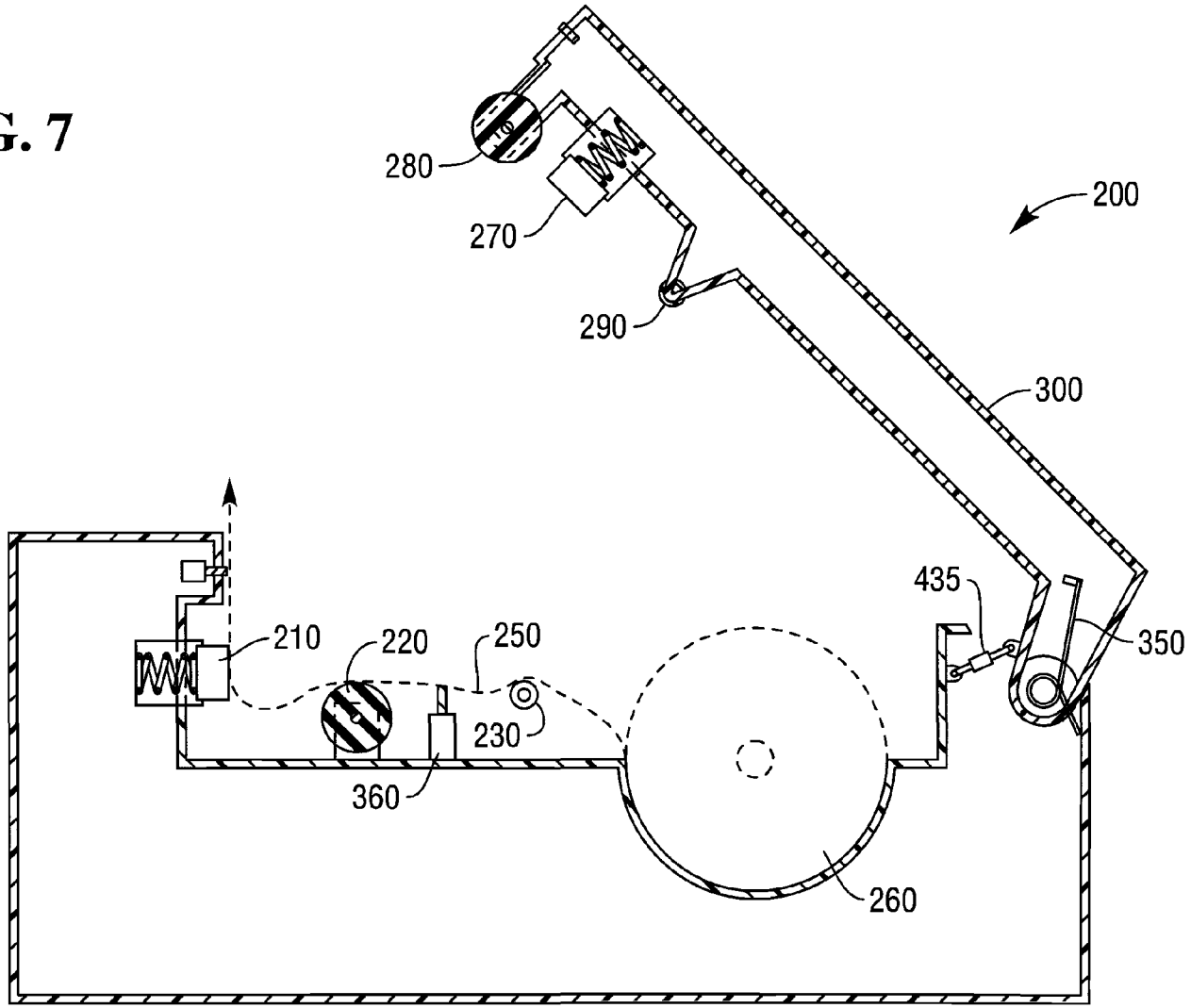
FIG. 7 schematically shows a partial centerline cross-sectional view of the dual-sided direct thermal receipt printer of FIG. 4, with a cover in an open position.

FIG. 7 schematically shows a partial centerline elevation view of the dual-sided direct thermal receipt printer 200 of FIG. 4 with the pivotable supporting arm or cover 300 in an open position to allow, for example, insertion and replacement of two-sided printing media rolls 260, and other servicing. A link 435 connects to (as shown) or is otherwise in operative contact with the cover 300 and base structure 240 to limit the open position of cover 300. The link 435 may further comprise a damping element to damp motion of the cover 300 such as where the cover 300 is opened under force of the spring 350. The combination of the link 435 and spring 350 comprise a mechanism for controlling the motion of the pivotable supporting arm or cover 300 for the two-sided direct thermal printer 200 to mitigate the potential for damage to printer components upon opening and closing of the cover 300. More generally, a mechanism for controlling the motion of the pivotable supporting arm or cover 300 may include one or more torsional elements such as springs, and/or one or more frictional or damping elements such as shock-absorbers or bushings to control the motion of the pivotable support arm or cover 300 such as by slowing down its rate of opening.

Figure 8:
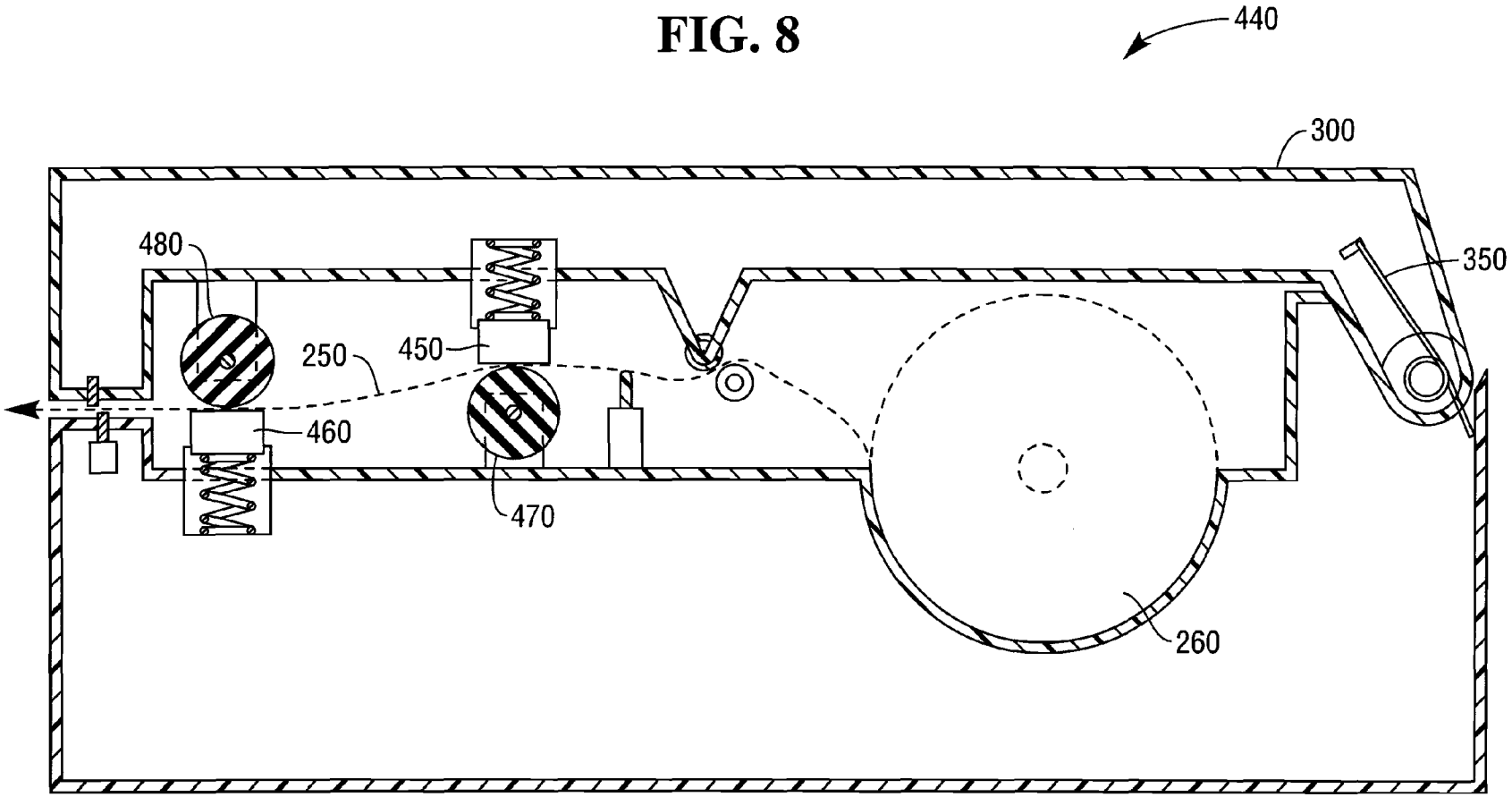
FIG. 8 schematically shows a partial centerline cross-sectional view of a variation of the dual-sided direct thermal receipt printer of FIG. 4.
Figure 13:
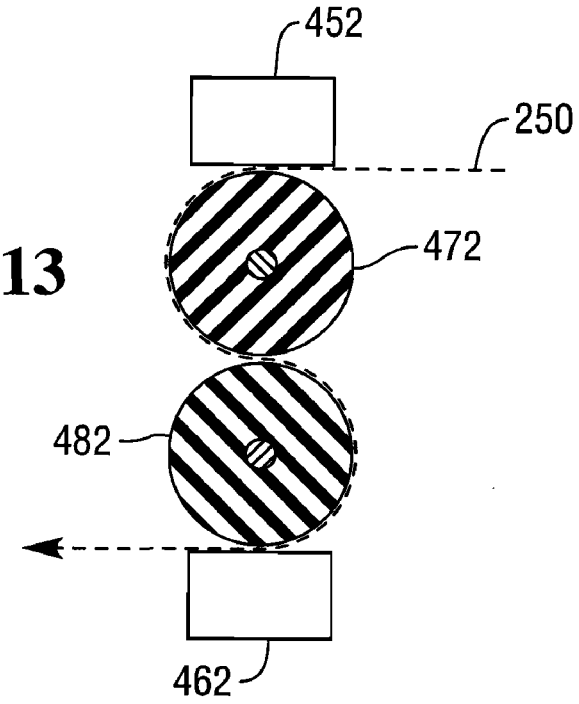
FIG. 13 schematically shows a further variation in a dual-sided direct thermal printer print head and platen orientation, and media feed path.
Figure 14:
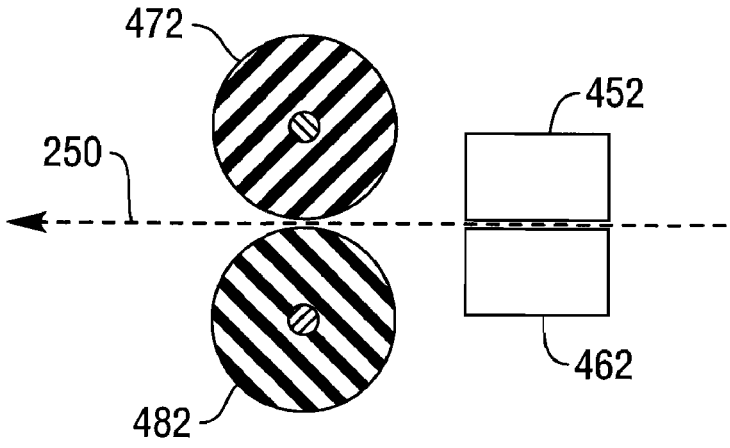
FIG. 14 schematically shows a further variation in a dual-sided direct thermal printer print head and platen orientation, and media feed path.

FIG. 8 schematically shows a partial centerline elevation view of a variation of the dual-sided direct thermal receipt printer of FIG. 4, with the cover 300 in a closed position. As shown the illustrated printer 440 includes two print heads 450 and 460, and two platens 470 and 480 on opposite sides of a print media feed path 250. Print heads 450 and 460 are substantially in-line and face substantially opposed directions. As a result, the feed path 250 of the print media is substantially a straight line path given the substantially in-line orientation of the print heads 450 and 460. This configuration facilitates frontal exiting of the print media from a machine associated with the printer 440 such as an ATM, kiosk or other self-service terminal. The in-line feed path also facilitates automation of media replacement including allowing the media to be automatically drawn from the first print head 450 and platen 470 to and through the second print head 460 and platen 480. This contrasts with the printer 200 shown in FIG. 5 where the print heads 210 and 270 are angled to face substantially normal directions, and the media feed path 250 takes an upward turn for the print media to exit the top of the printer 200. Automatic media feed and retraction may, however, also be provided for with the normal print head and platen configuration of FIG. 5, among other configurations. Further, additional print head (452 and 462) and platen (472 and 482) orientations, and resultant media feed paths (250), such that illustrated in FIGS. 13 and 14, are also possible.

Figure 9:
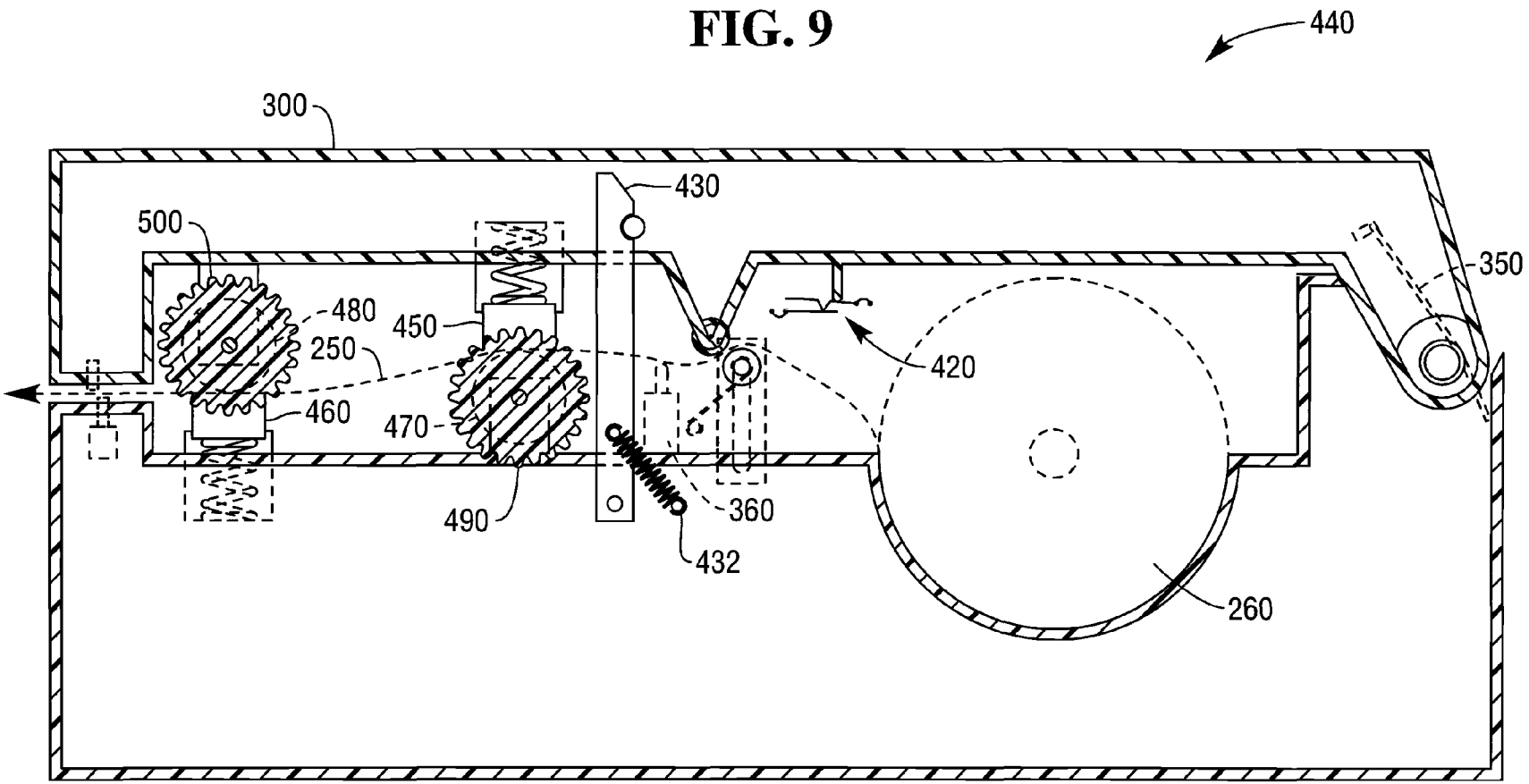
FIG. 9 schematically shows a partial gear plane cross-sectional view of the dual-sided direct thermal receipt printer of FIG. 8.

FIG. 9 schematically shows a partial drive or gear plane elevation view of the dual-sided direct thermal receipt printer 440 of FIG. 8. In FIG. 9 first and second gears 490 and 500 are respectively coupled to first and second platens 470 and 480. This configuration allows the first platen 470 and second platen 480 to be independently driven by one or more motors (not shown) operatively coupled to the first 490 and second 500 gears, respectively. In such case, the first platen 470 can be independently driven so as to pull the print media away from the roll 260 and direct it toward the second platen 500. Similarly, the second platen 480 can be independently driven so as to pull the print media away from the roll 260 and/or first platen 490, and direct it out of the printer 440. Likewise, the first and/or second platens can be independently driven so as to pull the print media away from the exit back into the printer 440, and/or away from the second print head 460 and platen 480. Such a dual drive media feed mechanism may be used to facilitate automatic retraction of the print media such that printing may occur on a portion of the media that would otherwise be unused owing to the offset in the spacing along the paper path of the print heads 450 and 460. Likewise, such a dual drive feed mechanism may be used to delay printing on one side of a print media as compared to the other side such as by allowing printing to occur on all or a portion of one side of the print media followed by a retract of the media for printing on all or a portion of the other side of the print media. Separate, forward and/or backward drive (not shown) of the media such as the media roll 260 may also be provided.

Figure 10:
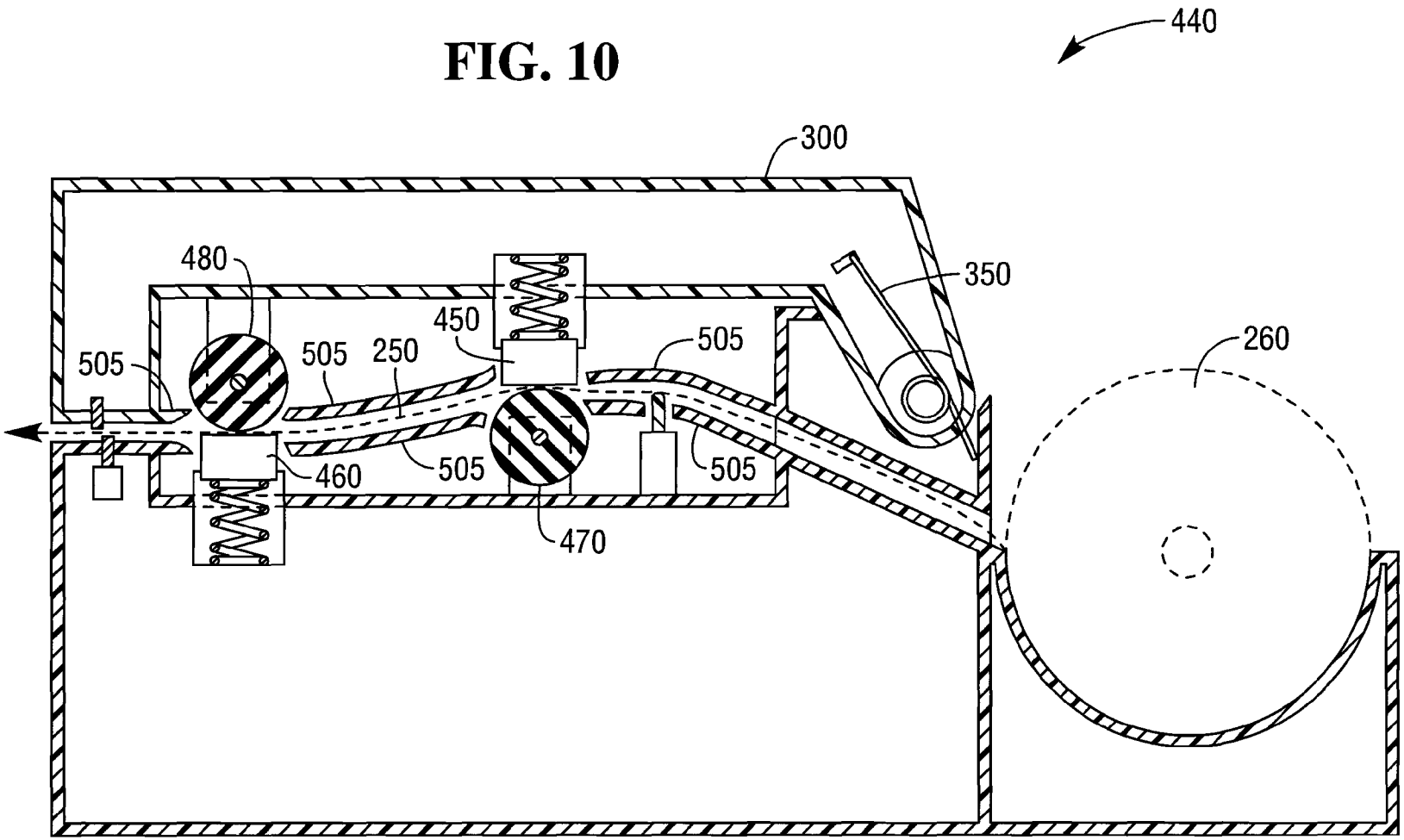
FIG. 10 schematically shows a partial centerline cross-sectional view of a variation of the dual-sided direct thermal receipt printer of FIG. 4.

FIG. 10 schematically shows a partial centerline elevation view of a further variation of the dual-sided thermal printer 440 of FIG. 8. In this instance, the printer 440 is designed to support print media such as a sheet roll 260 outside of the cover 300 to facilitate ready replacement of print media and/or relatively large media roll 260 sizes. As for the printer 440 shown in FIG. 8, the print heads 450 and 460 in the dual-sided thermal printer illustrated in FIG. 10 are substantially in-line and face substantially opposed directions. As a result, the feed path 250 of the print media is also substantially in-line facilitating automated replacement and loading of print media. One or more media guides 505 are further provided to align the media, and thereby facilitate automated media loading and feed.

Figure 11:
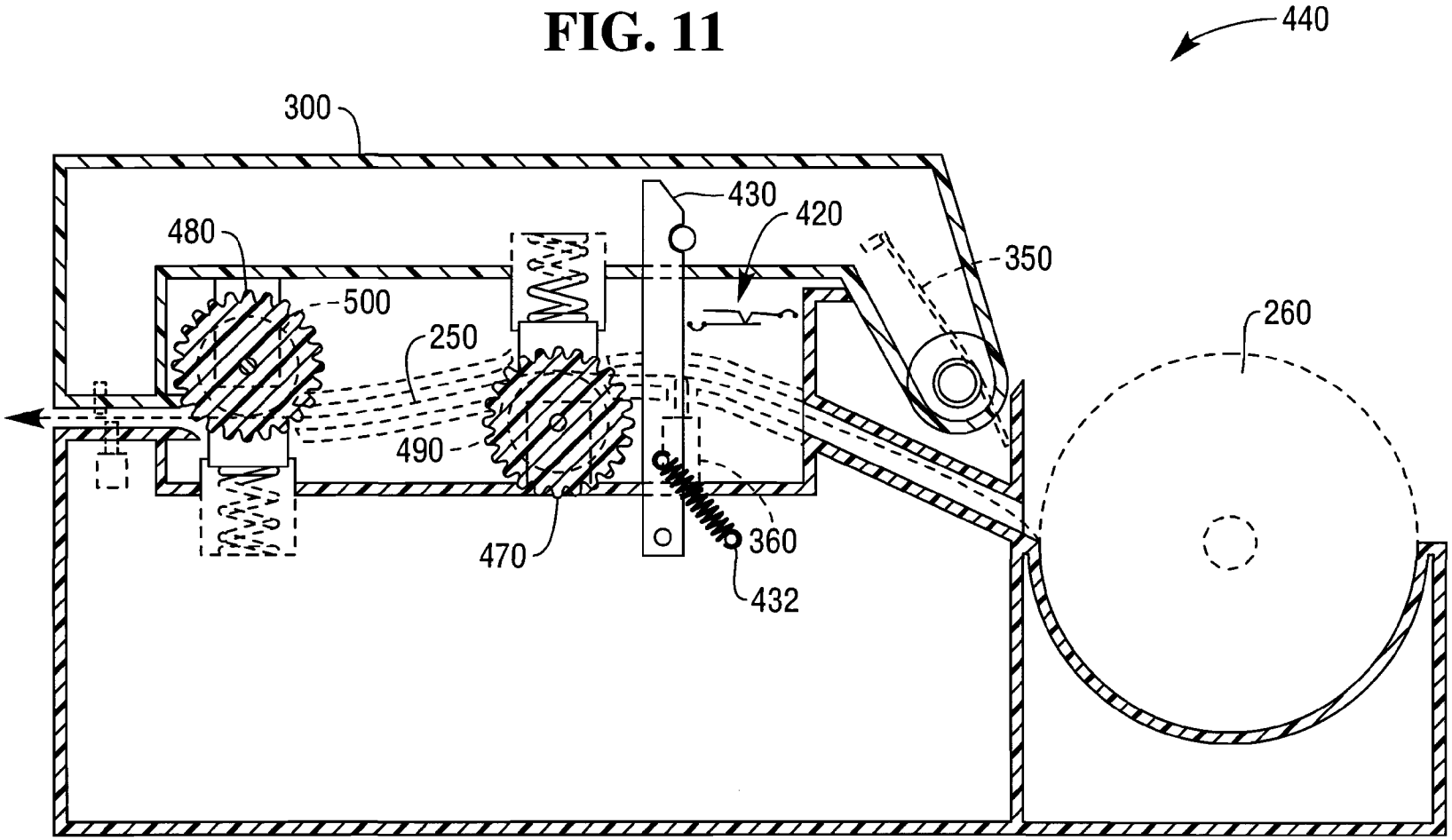
FIG. 11 schematically shows a partial gear plane cross-sectional view of the dual-sided direct thermal receipt printer of FIG. 10.

FIG. 11 schematically shows a partial drive or gear plane elevation view of the dual-sided direct thermal receipt printer 440 of FIG. 10 wherein first and second drive gears 470 and 480 are attached to respective first and second platens 490 and 500 for independently and/or collectively moving print media in a forward and/or backward direction along a media feed path 250.

Figure 12:
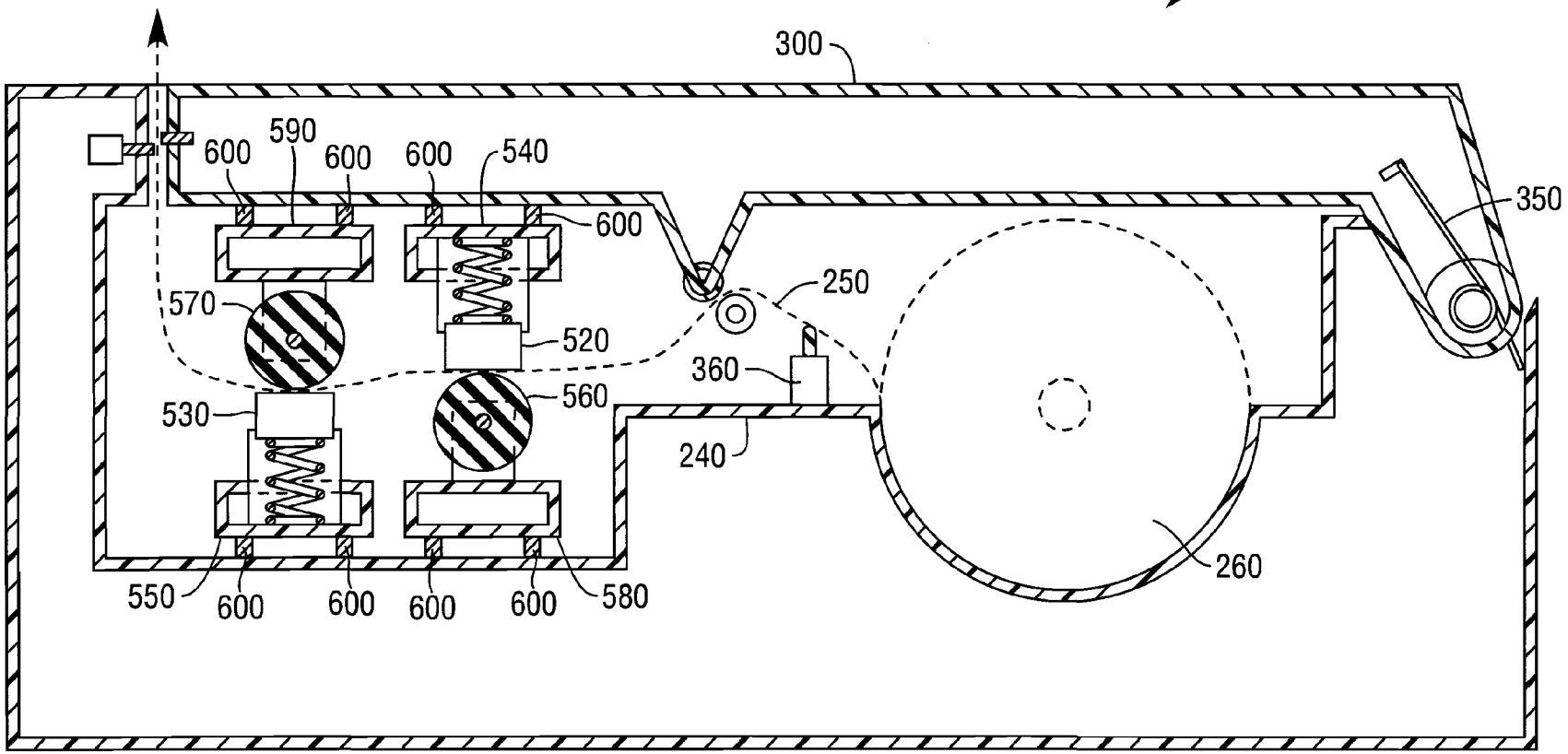
FIG. 12 schematically shows a partial centerline cross-sectional view of a further variation of the dual-sided direct thermal receipt printer of FIG. 4.

FIG. 12 schematically shows a partial centerline elevation view of a further variation of the dual-sided direct thermal receipt printer of FIG. 4. This printer configuration utilizes a modular construction in which the printer 510 has a first and a second print head 520 and 530 which are part of plug-in modules 540 and 550, respectively. Likewise, the printer 510 has first and second platens 560 and 570 which are part of plug-in modules 580 and 590, respectively. Such modular construction facilitates manufacture of a printer with a single print head and platen for operation in a single-sided print mode while simultaneously providing for ready, future upgrading to two-sided printer functionality in the field. Likewise, the modular construction allows readily replacement and/or upgrade of the various modules 540, 550, 580 and 590 for increased future functionality, or as the various print heads 520 and 530, and platens 560 and 570 wear out.

In alternate configurations, a modular printer 510 may have a first print head 520 and first platen 560 coupled into a single, first module, and a second print head 530 and second platen 570 coupled into a single, second module. Similarly, in a further variation, a first print head 520 and second platen 570 may be coupled into a first module, and the second print head 530 and first platen 560 may be coupled into a second module. Additional module print head and/or platen configurations and couplings are possible.

Regardless of the configuration, any of the attachments 600 used to attach any of the various modules to the cover 300 and/or base 240 may comprise static or dynamic (e.g., spring mounted) couplings for reducing mechanical stress on the various modules, and assisting in maintaining a desired contact pressure on the print media by the respective print heads and platens during print operations. In practice, each of the cover 300 and base 240 are appropriately modified (not shown) to readily accept the respective modules and associated attachments 600. It should be noted that the attachments 600 may comprise electrical contacts, electro-mechanical contacts, and/or mechanical contacts depending on the attachment module type (e.g., platen, print head, and platen and print head), and the like.

It will now be appreciated that a dual-sided thermal printer has been described for printing on both sides of thermal print media. Some alternative and/or additional embodiments will now be described.

Fixed Upper Support Arm or Cover

While the above described dual-sided direct thermal printer examples illustrate an upper support arm or cover 300 as being pivotable with respect to a lower support arm or base 240 about a hinge pin 310, the upper support arm or cover 300 may also be fixably attached, or otherwise coupled to the lower support arm or base 240, and not pivotable. In one example, the upper support arm or cover 300 is attached to the lower support arm or base 240 using one or more fasteners such as screws.

Dual-Sided Thermal Printer Print Head Configuration

In equipment with automated or automatic replacement media feed (e.g., automated in-feed of replacement thermal paper rolls or fan-fold stacks), such as ATM's and various other self-service terminals, a dual-sided thermal printer such as printer 440 of FIG. 10 typically has print heads 450 and 460 that are substantially in-line or in-plane. In retail applications with manual replacement roll paper feed, a dual-sided thermal printer such as printer 200 of FIG. 5 can have print heads 210 and 270 angled with respect to one another, e.g., at an angle of about 90 degrees to, for example, permit top exit of a receipt. Such angled orientation permits a reduced spacing between the print heads 210 and 270 for minimization of the length of unprinted areas or white spaces on opposite sides of the media in a once-through direct thermal printing process. Appropriate angles, aspect and location of one print head with respect to another and/or their respective platens will vary based on the printer end use and needs of the specific print media and/or print environments (i.e. kiosk printer, pharmacy printer, POS printer, and the like).

Optimized Print Head Spacing

The lateral spacing of a first and a second thermal print head (e.g., spacing 55 of FIG. 1) may be optimized to allow heat applied to a first side of a two-sided imaging element by the first print head to sufficiently dissipate so that heat applied to a second side of the imaging element by the second print head does not cause unwanted printing on the first side. The optimum spacing is a function of the amount of heat applied by the respective print heads, the imaging material and/or dyes utilized in the imaging element, properties of any coatings utilized in the imaging element including coating thickness and thermal conductivity, properties of any substrate utilized in the imaging element including substrate thickness and thermal conductivity, speed of printing, and the like.

Dual-Sided Thermal Printer Guide Roller Configuration

A dual-sided thermal printer 200 or 400 may comprise a pair of guide rollers 230 and 290 for maintaining a proper tension of print media, and guiding the media through the printer. The rollers can be respectively coupled to pivoting opposing arms that support print heads and platens. For example a print head, a platen and a guide roller can be coupled to a supporting arm or base structure on one side of the media feed path. Opposing print head, platen and guide roller elements can be coupled to a second supporting arm, e.g., a structure that pivots with respect to the base structure, that aligns on the opposite side of the media feed path. Each print head may thus be opposed by a platen and the guide rollers may oppose or be in proximate relation to one another across the media feed path. Contact pressure may be maintained against the print media by one or more springs urging the print heads against the platens. Similarly, one or both guide rollers may be spring loaded to maintain appropriate roller contact pressure with the print media. In an alternative configuration, two print heads may directly oppose one another across the feed path without platens. In one such configuration, each of two supporting arms may be coupled to an associated guide roller and one of the print heads. In another configuration a guide roller can comprise a pair of spaced coaxially aligned guide rollers. The space between the coaxially aligned guide rollers allows the addition of a variable size paper guide to accommodate different width media; whether rolls, fan-fold, sheet or otherwise.

Platen Configuration

In a dual-sided direct thermal printer such as the printer 200 shown in FIG. 5, platens 220 and 280 may have a substantially round cross-section. Likewise, in alternate embodiments, the platens 220 and 280 may have a substantially square or rectangular cross section, or otherwise present a substantially flat surface to either or both of the print heads 210 and 270. Further, regardless of the profile, each of the platens 220 and 280 may be substantially the same size and/or have substantially the same cross-sectional profile and/or area, or one platen may differ in one or more respects with regard to the other, including length.

Depending on their design and/or use, one or more platens or platen surfaces may comprise one or more coatings or materials. For example, where a platen is used to feed the media through the printer, as for platens 220 and 280 of FIG. 5, the platen and/or its surface may comprise a material providing for enhanced friction such as a rubber. Likewise, where the platen comprises a flat, sheet-type surface, the platen may comprise or be coated with a material providing for decreased friction such as polytetrafluoroethylene (PTFE).

In one embodiment, the platens have a substantially round cross-section of approximately ⅜ to ½ inch diameter, and are substantially the same length.

In another embodiment, two thermal print heads are substantially opposite each other across a media feed path and act as respective platens for each other. In such case, one or both of the thermal print heads may comprise or be coated with a friction reducing material.

Drive Mechanism

In a dual-sided direct thermal printer, media feed may be provide for by one or more belts, wheels, rollers, and the like. In one example, shown in FIG. 6, drive rollers in the form of platens 220 and 280 on opposite sides of a media feed path 250 are coupled for rotation by gears. Alternately, either of both platens can be jointly coupled or independently driven by, inter alia, (1) one or more belts or bands, (2) two or more meshing gears, (3) one or more direct drives, and/or (4) one or more direct contact frictional elements, any or all of which may be in operative contact with, or directly driven by, one or more drive motors or actuators.

Likewise, upstream and downstream platen drive mechanisms, such as motor driven upstream and downstream platens, which are capable of individual or simultaneous operation, may be provided. Advantageously, where it is desired to move an imaging element in a forward direction, power is provided to drive the downstream platen, while where it is desired to move the imaging medium in a reverse direction, power is provided to drive the upstream platen. The dual drive feed mechanism allows automatic retraction of an imaging element such that printing may occur on a portion of the element that would otherwise be un-used owing to an off-set in the spacing 55 of print heads in a two-sided printer, and the like. The automatic retraction feature could also be implemented by a single motor driving both platens, e.g., where the platens are commonly coupled for rotation by one or more belts, or two or more gears as shown in FIGS. 6 and 9, and the like.

Uniform Print Head Contact Pressure

A desired uniform print head to platen contact pressure across the width of a two-sided imaging element can be provided during printer operation. The mechanism for this may include one or more springs on or associated with the print heads, platens and/or common supports therefore, e.g., springs 320, 330 and/or 350 shown in FIG. 5, spring loaded attachments 600 shown in FIG. 12, and the like.

Printer Operating Permissives

Control electronics, such as one or more sensors 100, 360 and 420 in the form of one or more paper sensors to detect media presence and/or printing thereon, and contact switches to detect proper mechanical arrangement and alignment of print elements for printing, and the like, can be used to permit (e.g., as permissives) and control operation of a dual sided thermal printer and/or dual sided thermal printer functionality. For example, one or more contact sensors may be provided to allow printer operation only when the first and second print heads are properly positioned with regard to the first and second platens, a proper contact pressure is achieved between the first and second print heads and their respective platens, and/or a supporting pivotable arm structure or cover 300 is properly secured, etc. Likewise, one or more optical sensors may be provided to detect presence of and printing on print media for enabling and controlling location of thermal printing on the media.

Retractable Print Mechanism

A mechanism (not shown) may be provided for individually retracting one or both print heads and/or platens in a two-sided printer to allow the printer to function in a single-sided print mode while minimizing wear on the unused print head or platen. The retracting mechanism may be manually or automatically, e.g., electronically or electromechanically, actuated.

Printer Functionality

A two-sided thermal printer and associated firmware for two-sided printing may advantageously support the following functions:

1. Single-sided print mode. This print mode supports basic single-sided printing, allowing operation of thermal print heads on one side of a media feed path.

2. Double-sided with single-side command mode (e.g., buffered print mode). This print mode will allow for the storage of some or all of the print data by the printer in advance of imaging the media. Print data received from, for example, a POS terminal (not shown) is stored in a print buffer 80 until an end-of-transaction message such as a knife (cut) command is received. Once the knife command is received the firmware will then divide the buffered print data and designate a first portion, such as a first half of the data, for printing on the first (e.g., front) side of the media, and a second portion of the data, such as the remaining half, for printing on the second (e.g., back) side of the media. After the designated data is printed on the respective first and second sides, then a physical knife cut by the knife blade mechanism 370 of roll media, a line feed to an end of sheet media, and the like, may be performed completing the print job. The double-sided buffered print mode may be enabled by manually setting of one or more DIP or other switches or jumpers, through use of a diagnostic set up routine, by sending an escape code or command, e.g., the 1F 11 xx command, to the printer, and the like.

3. Double-sided with double-side command mode (e.g., application controlled print mode). This print mode allows for control of double-sided print functionality by an application program such as transaction software running on a POS terminal. Such application may control printing through controlling the location of print data on a first (e.g., front) and a second (e.g., back) side of media such as a receipt, when and in what sequence the application data is to be printed, and the like. The double-side command mode may store application print data in one or more buffer or other memory locations prior to printing. Likewise it may select predefined data from one or more buffer or other memory locations to print at one or more locations of one or both sides of the media with or without application print data. The double-sided command mode may be initiated through receipt of one or more double-sided sided print commands, a diagnostic routine, through manual setting of switches or jumpers, and the like.

4. Double-sided print mode with predefined data. When operated in this mode, predefined data from one or more of predefined print data storage facilities (e.g., buffer or other memory locations) may be printed on one side of a two-sided thermal media, and application data, such as POS terminal transaction information, may be printed on another side separate from the predefined data print side. When this mode is selected, the printer may initiate printing on both sides of the media, or store the application print data in the data storage facility 80 until a command for initiating double-sided printing is received. The double-sided print mode with predefined data may be initiated through receipt of one or more associated commands, through use of a diagnostic routine, through manual setting of switches or jumpers, and the like.

Printer Capabilities

A dual-sided thermal printer 200 preferably has the following capabilities:

Print Speed: 4.0 inches per second (IPS) when 55 watt power is provided. This includes front and back printing.

Print Speed: 6.7 IPS when 75 watt power is provided. This includes front and back printing.

Print Buffer: Up to 450 print lines at 7.5 lines per inch (LPI) assuming 44 characters/line Logo/Text Storage.

Preferred Default Limitations

When printing, it is preferred that the character attributes be the same for the front and the back side of the receipt. For example if double high printing is printed on the front side then the printing on the back side would also be double high. Alternate front/back characters sizes and/or fonts are, however, possible.

When printing in the double-sided buffered print mode and the capacity of the print buffer 80 is exceeded, the printer can distribute the buffered data for printing on each side of the media, and then print the remaining data on one side, e.g., the front side of a receipt, prior to performing a knife cut. Alternately, the printer can distribute and print the buffered among the two sides then refill the print buffer 80 with additional print data, and continue this process until an end-of-transaction message such as a knife cut command, is received.

Status Update Messages

The following table defines exemplary dual-sided thermal printer sensor or state information specified by each identifier, and meanings of the lower 4 bits of the 3rd byte for identifier values:

| Identifier Value (Hex) | Description of sensor or state RTC Sensor Bit if Applicable for 7167/7197 (Note: RTC might be different for other printers) | State Value | Meaning |
|---|---|---|---|
| 12 | Slip Motor Jam | 1 | Motor in Jam state |
| | RTC Response (10 04 03) - Bit 2 | 0 | Normal State |
| 13 | Knife Condition | 1 | Knife in Error Condition |
| | RTC Response (10 04 03) - Bit 3 | 0 | Normal State |
| 14 | Unrecoverable Error | 1 | Unrecoverable Error Encountered |
| | RTC Response (10 04 03) - Bit 5 | 0 | Printer has been Reset |
| 15 | Thermal Print Head Temperature | 1 | Out of operating range |
| | RTC Response (10 04 03) - Bit 6 | 0 | Normal operating range |
| 16 | Power Supply Voltage | 1 | Out of operating range |
| | RTC Response (10 04 03) - Bit 6 | 0 | Normal operating range |
| 17 | Printer Paper Sensor | 1 | Paper Present |
| | RTC Response (10 19 01) - Bit 0 | 0 | No Paper |
| 18 | Printer Reset | 1 | Printer Physical Reset Took Place |
| | RTC Response (10 19 01) - Bit 6 | | |
| 19 | Presenter Mechanism State | 1 | Presenter in Error |
| | RTC Response (10 19 02) - Bit 0 | 0 | Presenter in Normal State |
| 1A | Paper Jam status | 1 | Printer is in Jam State |
| | RTC Response (10 19 02) - Bit 1 | 0 | Printer in Normal State |
| 1B | Kiosk Door State | 1 | Door Open |
| | RTC Response (10 19 02) - Bit 3 | 0 | Door Closed |
| 1C | Black Mark Detection Status | 1 | Detection Failure |
| | RTC Response (10 19 02) - Bit 5 | 0 | Normal Status |
| 1D | Print Head Condition | 1 | Print Head Damaged |
| | RTC Response (10 19 02) - Bit 6 | 0 | Print Head OK |
| 1E | Flip Mechanism Door State | 1 | Door Open |
| | No RTC equivalent | 0 | Door Closed |
| 1D | Double-side buffer exceed | 1 | Received data exceed double-side buffer |
| | No RTC Equivalent | 0 | Double-side buffer adequate |

Exemplary Two-Sided Print Command Overview:

| m (Hex) | Function | n (Hex) | Function |
|---|---|---|---|
| 60 | Thermal Printing Mode | 00 | Single-Sided Mode |
| | | 01 | Double-Sided Mode with Single-Side command |
| | | 02 | Double-Sided Mode with Double-Side Command |
| | | 03 | Double-Sided Mode with Predefined Data |
| | Upside Down Printing for Double-Side | 03 | data |
| 62 | Swap Front Side and Back Side | 00 | Not Swap Front side and Back sides |
| | | 01 | |
| 63 | Predefined Bottom/Top Message | 00 | No Message Bottom Message on Front |
| | | 01 | Top Message on Back Both Bottom |
| | | 02 | Message on Front and Top Message |
| | | 03 | on Back |
| 64 | Minimum Receipt Length | 00 | No Minimum Receipt Length in inches |
| | | 01–FF | for Minimum receipt length |
| 65 | Reprint when Error Occurs | 00 | Resume printing from last error line |
| | | 01 | Reprint the error page |

Exemplary Two-sided Printer Command Description (e.g., Real Time Commands):

Exemplary Select Thermal Printing Mode Command:

ASCII: US 'n

Hexadecimal: 1F 60 n

Decimal: 31 96 n

Value of n:

0=Single-Sided Mode

1=Double-Sided Mode with Single-Side Command

2=Double-Sided Mode with Double-Side Command

3=Double-Sided Mode with Predefined Data

Default: n=0 (Single-Sided Mode). Selects the thermal printing mode; single-side or double-side print mode. If single-side mode is selected, thermal printing can only be executed on one (e.g., front) side of receipt paper. If double-side mode is selected, printing can be executed on front side or/and backside of receipt paper. With selection n=0, printing format is same as existing firmware.

Selection n=1 (Double-Sided Mode with Single-Side Command), print data is buffered and split in two parts. The first part of the print buffer will be printed on a first (e.g., front) side and the second part of the print buffer will be printed on a second (e.g., back) side of the media such as receipt paper. The printing of the data may be executed by, for example, sending a knife or other end of transaction command to the printer (Exception: The command Select Thermal Printing Side and Start Double-Sided Printing would be ignored).

Selection n=2 (Double-Side Mode with Double-Side Command), print data is selectively buffered and printed on the front and back side of media such as receipt paper upon command from an application program, such as software executed by a POS terminal. In addition to print data received from an application program, such as POS terminal transaction information, such print data may include predefined print data stored in one or more buffer or other memory locations of the printer.

Selection n=3 (Double-Side Mode with Predefined data), application program data, such as POS terminal transaction data, may be buffered and/or printed on a first side of thermal media, and predefined data, such as one or more of an advertisement, incentive, coupon, rebate or other information, may be printed on a second side of the thermal media. Data printed on a given media side may be switched such that, for example, transaction data is printed on a front side and predefined data is printed on a back side, and vice versa. Likewise, a given predefined data block may be printed only once for a given document such as a receipt. Document length is determined by the print data (e.g., transaction versus predefined) requiring the greater amount space.

The setting of this command is not stored into NVRAM/Flash memory.

The Printer Setting Change command (e.g., 1FH 11H) is used to store the setting.

Sending a 1Fh 62h will print data

Exemplary Select Thermal Printing Side Command:

ASCII: US a n

Hexadecimal: 1F 61 n

Decimal: 31 97 n

Value of n:

0=Front Side

1=Back Side

Default: 0 (Front Side)

Selects the thermal printing side: front side or back side. This command executes when the Thermal Printing Modes, Double-Side Mode with Double-Side Command is selected (n=2), otherwise, this command is ignored. This command is valid for subsequent lines.

If data exceeds buffer size, printer prints out automatically and print buffer is cleared. Printer mode remains unchanged.

Exemplary Limitations:

Character attributes are same for both sides. For example, when the front side printing characteristic is Double wide, the back side printing characteristic is also Double wide. When either side of printing area is lager than printing buffer (TBD: XX inch), printer will start printing automatically then printer return to single-sided printing.

Exemplary Start Double-Sided Printing Command:

ASCII: US b

Hexadecimal: 1F 62

Decimal: 31 98

Starts double-sided printing. This command executes if the Thermal Printing Modes, Double-Side Mode with Double-Side Command is selected (n=2), otherwise, this command is ignored. The paper length is determined by the longest side of the print data.

Exemplary Select or Cancel Upside Down Printing for Double-Side Mode Command:

ASCII: US c n2

Hexadecimal: 1F 63 n

Decimal: 31 99 n

Value of n:

Bit 0=0: Cancel Front Side upside down printing

Bit 0=1: Enable Front Side upside down printing

Bit 1=0: Cancel Back Side upside down printing

Bit 1=1: Enable Back Side upside down printing

Printing side (Front/Back side) is physical side of printing.

Default: 0 (Cancel upside printing for both sides)

This command makes the first line becomes the last line, and the first character of first line becomes the last character of last line. This command is valid in Double-Side Mode. Before starting double-side printing, only the last received select or cancel upside down printing command is effective. The setting of this command is not stored into NVRAM/Flash memory. The Printer Setting Change command (e.g., 1FH 11H) is used to store setting.

Exemplary Swap Front Side and Back Side Command:

ASCII: US d n

Hexadecimal: 1F 64 n

Decimal: 31 100 n

Value of n:

0: Cancel swap.

1: Swap Front Side and Back Side. Original Front Side data is printed on backside and original Back Side data is printed on front side.

Default: 0 (Cancel swap)

This command will swap the printing of the front side data and backside data when the printer is in Double-Side Mode. Before swapping Front Side and Back Side, the Front Side data is printed via Front Side thermal head. After swapping, the Front Side data is printed via Backside thermal head.

Before starting double-side printing, only the last received swap front side and backside command is effective.

The setting of this command is not stored into NVRAM/Flash memory.

The Printer Setting Change command (e.g., 1FH 11H) is used to store setting.

Exemplary Limitations: For Double-Side Mode w/Single-Side Command, if Logo is printed immediately before paper cut, after swap, the printing pattern on Front Side (Backside before swap) will have blank (e.g., 35 mm long) area.

Download Predefined 1-line Text Message into Printer Buffer ROM Command

ASCII: US e n k d1 d2 . . . dk NUL

Hexadecimal: 1F 65 n k d1 d2 . . . dk 0

Decimal: 31 101 n k d1 d2 . . . dk 0

Value of n:

n: The line number. n=0, 1, 2, 3.

k: The character attribute d1, d2, . . . , dk Strings of 1-line Text Message. Strings terminated with NUL This command will download one line of text into ROM. The message is used in all Double-Side Modes. User can select to automatically add a 1-line/2-line text message at bottom of Front Side or/and at top of Back Side. Front Side uses line 0 and line 1 and Back Side uses line 2 and line 3. Printing side (Front/Back side) is logical side of printing.

Exemplary Settings of Download Command Character Attribute:

| K | | |
|---|---|---|
| Bit 7 | 0: Italic Mode off | 1: Italic Mode on |
| Bit 6 | 0: Inverse video mode off | 1: Inverse video mode on |
| Bit 5 | 0: Underline mode off | 1: 1 dot underline |
| Bit 4 | 0: Emphasize mode off | 1: Emphasize mode on |
| Bit 3 | 0: Double width off | 1: Double width on |
| Bit 2 | 0: Double height off | 1: Double height on |
| Bit 1 & 0 | 00H: ANK/= 01H: Double Byte Asian character 10H: Single Byte Asian Character | |

Exemplary Enable predefined bottom/top message Command:

ASCII: US f n

Hexadecimal: 1F 66 n

Decimal: 31 102 n

Value of n:

Bit 0=0: Disable predefined bottom message on front side

Bit 0=1: Enable predefined bottom message on front side

Bit 1=0: Disable predefined top message on back side

Bit 1=1: Enable predefined top message on back side

Default: 0 (Disable predefined bottom and top message)

When this function is enabled, printer will automatically add a 1-line or 2-line text message at the bottom/top of front side/backside of receipt. This command is only valid in Double-Side Mode (All w/Single-Side Command and w/Double-Side Command and w/Predefined data). The setting of this command is not stored into NVRAM/Flash memory.

The Printer Setting Change command (e.g., 1FH 11H) is used to store setting.

Exemplary Select nth Macro Command:

ASCII: US g n

Hexadecimal: 1F 67 n

Decimal: 31 103 n

Value of n: 1 to 25

Default: n=1

Select nth macro for definition or execution.

If this command is received during definition of a macro, the current definition will be cleared. The same commands are used to define macro and execute macro as below.

Start or End Macro Definition (GS:)

Execute Macro (GS ^) The Macro size is 2048 bytes each.

Exemplary Limitations: Characters exceeded one line will be ignored. If command sequence is US e n k NUL, printer will clear the nth line message in Flash ROM. If only one line is defined, printer will only print the defined line. Some attributes may not be supported—Script mode, 2-dot underline mode, Double strike mode, 90° Left/Right Rotation, Black/Red, Print Start Position, Character size≧3. Attribute cannot be changed in one line.

Exemplary Start or End Predefined Back Side Printing Command:

ASCII: US h

Hexadecimal: 1F 68

Decimal: 31 104

Starts or ends Predefined Back Side Printing and stored into the printer buffer ROM. Predefined back side printing definition begins when this command is received during normal operation and ends when this command is received during Predefined back side printing definition. If the printer receives a second "Start or End Predefined Back Side Printing" immediately after previously receiving a "Start or End Predefined Back Side Printing" the printer will clear Predefined Back Side Printing. If this command is received during a Macro's definition (GS:), the current Macro definition will be cleared. During definition of predefined backside printing, receive command GS: (Start or End Macro Definition) will make the current definition be cleared.

Exemplary Define Minimum Receipt Length Command:

ASCII: US i n1 n2

Hexadecimal: 1F 69 n1n2

Decimal: 31 105 n1 n2

Range of n1: 0-255

Range of n2: 0-255

Default:

n1=0 n2=0

This command defines the minimum media (e.g., receipt) length to start the conversion from single-side to double-side printing. This setting is enabled for only "Double-Sided Mode with Single-Side Command".

Formulas:

To set minimum document/receipt length to two inches at the default horizontal motion unit of 1/203 inches, send the four-byte string:

US i 150 1

Where 2 inches=406/203, and 406=(1×256)+150.

Exemplary Limitations:

Character attributes are same for both sides. For example, when the front side printing characteristic is Double wide, the back side printing characteristic is also Double wide. When either side of printing area is larger than printing buffer, printer will start printing automatically then printer return to single-sided printing.

Exemplary Configuration Menu Double-Sided Printing Settings:

Press the Paper Feed Button for the double-side printing settings you want.

Defaults are marked with an asterisk (*)

** SET Thermal Printing Mode?

YES>Long Click

NO>Short Click

Single-Side*>1 Click

Double-Side w/Single Cmd>2 Clicks

Double-Side w/Double Cmd>3 Clicks

Double-Side w/Predefined Data>4 Clicks

Enter code, then hold Button Down at least 1 second to validate

** SET Upside Down Mode?

YES>Long Click

NO>Short Click

F:Normal, B:Normal*>1 Click

F:Up Down, B:Normal>2 Clicks

F:Normal, B:Up Down>3 Clicks

F:Up Down, B:Up Down>4 Clicks

Enter code, then hold Button DOWN at least 1 second to validate

** SET Swap Front & Back?

YES>Long Click

NO>Short

Click

Disable*>1 Click

Enable>2 Clicks

Enter code, then hold Button DOWN at least 1 second to validate

** SET Bottom and Top Message?

YES>Long Click

NO>Short Click

Top: Disable, Bottom: Disable*>1 Click

Top: Enable, Bottom: Disable>2 Clicks

Top: Disable, Bottom: Enable>3 Clicks

Top: Enable, Bottom: Enable>4 Clicks

Enter code, then hold Button DOWN at least 1 second to validate

** SET Minimum Receipt Length?

YES>Long Click

NO>Short Click

Disable*>1 Click 5 inch>2 Clicks 10 inch>3 Clicks 15 inch>4 Clicks

Enter code, then hold Button DOWN at least 1 second to validate.

** SET Reprint when Error Occurs?

YES>Long Click

NO>Short Click

Resume Print from Error Line*>1 Click

Reprint the Error Page>2 Clicks

Enter code, then hold Button DOWN at least 1 second to validate

The above description is illustrative, and not restrictive. In particular, designation of a first and a second print head, platen, gear, and the like, as well as a front and a back media side or a top or a bottom media portion, may vary among embodiments.

Further, many other embodiments will be apparent to those of skill in the art upon reviewing the above description. The scope of the embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the description of the embodiments, with each claim standing on its own as a separate exemplary embodiment.

What is claimed is:

1. A method of operating a dual-sided direct thermal printer comprising a first thermal print head on a first side of a media feed path and a second thermal print head on a second side of the media feed path opposite the first side, the method comprising:

receiving a select thermal printing mode command directing operation of the dual-sided direct thermal printer in one of (i) a single-sided printing mode wherein the dual-sided direct thermal printer is operative to print data using only one of the first and the second thermal print heads, and (ii) a dual-sided printing mode wherein the dual-sided direct thermal printer is operative to print data using both the first and the second thermal print heads; and operating the dual-sided direct thermal printer according to the received select thermal printing mode command;

wherein receiving a select thermal printing mode command directing operation of the dual-sided direct thermal printer in a dual-sided printing mode comprises receiving a select thermal printing mode command directing the dual-sided direct thermal printer to operate in one of (i) a double-sided with single-side command mode, wherein the dual-sided direct thermal printer is operative to print a first portion of received print data using one of the first and the second thermal print heads and a second portion of the received print data using the other of the first and the second thermal print heads, (ii) a double-sided with double-side command mode, wherein the dual-sided direct thermal printer is operative to print received print data using one or both of the first and the second thermal print heads according to received print location data, and (iii) a double-sided with predefined data command mode, wherein the dual-sided direct thermal printer is operative to print received print data using one of the first and the second thermal print heads and predefined print data stored in one or more memories associated with the dual-sided direct thermal printer using the other of the first and the second thermal print heads.

2. The method of claim 1, wherein receiving a select thermal printing mode command comprises receiving one of a 1F 60 00, a 1F 60 01, a 1F 60 02, and a 1F 60 03 hexadecimal command directing operation of the dual-sided direct thermal printer in the single-sided printing mode, the double-sided with single-side command mode, the double-sided with double-side command mode, and the double-sided with predefined data command mode, respectively.

3. The method of claim 1, wherein receiving the select thermal printing mode command further comprises receiving print data.

4. The method of claim 1, wherein the dual-sided direct thermal printer defaults to operating in the single-sided printing mode.

5. The method of claim 1, further comprising:

receiving a store printer setting change command;

storing the received select thermal printing mode command in a memory associated with the dual-sided direct thermal printer in response to receipt of the store printer setting change command; and operating the dual-sided direct thermal printer according to the stored select thermal printing mode command.

6. The method of claim 5, wherein the store printer setting change command comprises a 1FH 11H hexadecimal command.

7. The method of claim 1, further comprising:

receiving a select thermal printing side command selecting the first or the second thermal print head for printing; and directing the dual-sided direct thermal printer to print received print data with the first or the second thermal print head according to the received select thermal printing side command.

8. The method of claim 7, wherein receiving the select thermal printing side command comprises receiving a 1F 61 00 hexadecimal command to select the first thermal print head for printing and a 1F 61 01 hexadecimal command to select the second thermal print head for printing.

9. The method of claim 7, wherein the dual-sided direct thermal printer defaults to printing with the first thermal print head.

10. The method of claim 7, wherein the dual-sided direct thermal printer defaults to printing with the second thermal print head.

11. The method of claim 7, further comprising:

receiving print data; and initiating printing by the selected first or second thermal print head when the quantity of received print data exceeds a print buffer size.

12. The method of claim 1, further comprising:

receiving a select or a cancel upside down printing for double-side mode command;

directing the dual-sided direct thermal printer to print the last received print data first and the first received print data last by one or both of the first and the second thermal print heads in response to receiving a select upside down printing for double-side mode command; and directing the dual-sided direct thermal printer to print the first received print data first and the last received print data last by one or both of the first and the second thermal print heads in response to receiving a cancel upside down printing for double-side mode command.

13. The method of claim 12, wherein receiving a select or a cancel upside down printing for double-side mode command comprises receiving a 1F 63 00, a 1F 63 01, a 1F 63 10 and a 1F 63 11 hexadecimal command to cancel upside down printing by the first and the second thermal print heads, cancel upside down printing by the first thermal print head and select upside down printing by the second thermal print head, select upside down printing by the first thermal print head and cancel upside down printing by the second thermal print head, and select upside down printing by the first and the second thermal print heads, respectively.

14. The method of claim 12, wherein the dual-sided direct thermal printer defaults to cancel upside printing by the first and the second thermal print heads.

15. The method of claim 12, wherein the received select or cancel upside down printing for double-side mode command is effective only when the dual-sided direct thermal printer is operating in a dual-sided printing mode.

16. The method of claim 1, further comprising:

identifying first data for printing by the first thermal print head;

identifying second data for printing by the second thermal print head;

receiving a select or a cancel swap front side and back side command;

printing the first data by the second thermal print head and the second data by the first thermal print head in response to receiving a select swap front side and back side command; and printing the first data by the first thermal print head and the second data by the second thermal print head in response to receiving a cancel swap front side and back side command.

17. The method of claim 16, wherein receiving a cancel swap front side and back side command comprises receiving a 1F 64 00 hexadecimal command, and receiving a select swap front side and back side command comprises receiving a 1F 64 01 hexadecimal command.

18. The method of claim 16, wherein the dual-sided direct thermal printer defaults to printing the first data by the first thermal print head and the second data by the second thermal print head.

19. The method of claim 16, wherein the received select or cancel swap front side and back side command is effective only when the dual-sided direct thermal printer is operating in a dual-sided printing mode.

20. The method of claim 1, further comprising:

receiving a download predefined message command; and loading a one-line text message into a memory associated with the dual-sided direct thermal printer in response to receipt of the download predefined message command.

21. The method of claim 20, wherein the download predefined message command comprises one of a 1F 65 00, a 1F 65 01, a 1F 65 02, and a 1F 65 03 hexadecimal command.

22. The method of claim 21, further comprising:

designated the one-line text message for printing by the first thermal print head when the download predefined message command comprises a 1F 65 00 or a 1F 65 01 hexadecimal command; and designating the one-line text message for printing by the second thermal print head when the download predefined message command comprises a 1F 65 02 or a 1F 65 03 hexadecimal command.

23. The method of claim 20, wherein receiving the download predefined message command further comprises receiving the one-line text message.

24. The method of claim 23, wherein the one-line text message terminates with a NUL character.

25. The method of claim 20, further comprising:

receiving character attribute data defining print attributes for the one-line text message.

26. The method of claim 25, wherein the defined print attributes comprise one or more of italic printing, inverse video printing, underline printing, double width printing and double height printing.

27. The method of claim 20, wherein the received download predefined message command is effective only when the dual-sided direct thermal printer is operating in a dual-sided printing mode.

28. The method of claim 1, further comprising:

receiving an enable or a disable predefined message command;

enabling automatic printing of one or more one-line text messages stored in a memory associated with the dual-sided direct thermal printer by one or both of the first and the second thermal print heads in response to receipt of an enable predefined message command; and disabling automatic printing of one or more one-line text messages stored in a memory associated with the dual-sided direct thermal printer by one or both of the first and the second thermal print heads in response to receipt of a disable predefined message command.

29. The method of claim 28, wherein receiving an enable or a disable predefined message command comprises receiving one of a 1F 66 00, a 1F 66 01, a 1F 66 02, and a 1F 66 03 hexadecimal command.

30. The method of claim 29, wherein automatic printing of one or more one-line text messages by a first thermal print head is enabled upon receipt of a 1F 66 01 hexadecimal command and disabled upon receipt of a 1F 66 00 hexadecimal command.

31. The method of claim 29, wherein automatic printing of one or more one-line text messages by a second thermal print head is enabled upon receipt of a 1F 66 03 hexadecimal command and disabled upon receipt of a 1F 66 02 hexadecimal command.

32. The method of claim 28, wherein the dual-sided direct thermal printer defaults to disabling automatic printing of one or more one-line text messages by the first and the second thermal print heads.

33. The method of claim 28, wherein the received enable or disable predefined message command is effective only when the dual-sided direct thermal printer is operating in a dual-sided printing mode.

34. The method of claim 1, further comprising:

receiving a select nth macro command identifying a memory storage location associated with the dual-sided direct thermal printer for storage or execution of a macro.

35. The method of claim 34, wherein receiving a select nth macro command comprises receiving a 1F 67 n hexadecimal command, wherein n identifies the memory storage location.

36. The method of claim 35, wherein n is an integer ranging from 1 to 25.

37. The method of claim 36, wherein, when not otherwise specified, n defaults to 1.

38. The method of claim 35, further comprising:

clearing an existing macro stored in the identified memory storage location when the select nth macro command is received during definition of a macro.

39. The method of claim 34, wherein the memory storage location comprises 2048 bytes.

40. The method of claim 1, further comprising:

receiving a start or end predefined back side printing command;

alternately starting or ending printing of predefined print data by one of the first and the second thermal print heads when a start or end predefined back side printing command is received.

41. The method of claim 40, wherein the start or the end predefined back side printing command comprises a 1F 68 hexadecimal command.

42. The method of claim 40, further comprising:

retrieving the predefined print data from a memory storage location associated with the dual-sided direct thermal printer.

43. The method of claim 42, further comprising:

receiving a select nth macro command identifying the memory storage location from which to retrieve the predefined print data; and retrieving the predefined print data from the identified memory storage location.

44. The method of claim 1, further comprising:

receiving a define minimum media length command defining a minimum media length at which printing by both the first and the second thermal print head is allowed; and allowing printing by both the first and the second thermal print heads when a required media length exceeds the minimum media length.

45. The method of claim 44, wherein the define minimum media length command comprises a 1F 69 n1n2 hexadecimal command, and n1 and n2 define the minimum media length.

46. The method of claim 45, wherein n1 and n2 range from 0 to 255.

47. The method of claim 45, wherein n1 and n2 default to 0.

48. The method of claim 44, wherein the received define minimum media length command is effective only when the dual-sided direct thermal printer is operating in a dual-sided printing mode wherein the dual-sided direct thermal printer is operative to print a first portion of received print data using one of the first and the second thermal print heads and a second portion of the received print data using the other of the first and the second thermal print heads.

49. A dual-sided direct thermal printer comprising:

a first thermal print head on a first side of a media feed path;

a second thermal print head on a second side of the media feed path opposite the first side;

a communication controller configured to receive a select thermal printing mode command directing operation of the dual-sided direct thermal printer in one of (i) a single-sided printing mode wherein the dual-sided direct thermal printer is operative to print data using only one of the first and the second thermal print heads, and (ii) a dual-sided printing mode wherein the dual-sided direct thermal printer is operative to print data using both the first and the second thermal print heads; and a printing function switch configured to operate the dual-sided direct thermal printer according to the received select thermal printing mode command;

wherein the select thermal printing mode command directing operation of the dual-sided direct thermal printer in a dual-sided printing mode comprises a select thermal printing mode command directing operation of the dual-sided direct thermal printer in one of (i) a double-sided with single-side command mode, wherein the dual-sided direct thermal printer is operative to print a first portion of received print data using one of the first and the second thermal print heads and a second portion of the received print data using the other of the first and the second thermal print heads, (ii) a double-sided with double-side command mode, wherein the dual-sided direct thermal printer is operative to print received print data using one or both of the first and the second thermal print heads according to received print location data, and (iii) a double-sided with predefined data command mode, wherein the dual-sided direct thermal printer is operative to print received print data using one of the first and the second thermal print heads and predefined print data stored in one or more memories associated with the dual-sided direct thermal printer using the other of the first and the second thermal print heads.

50. The dual-sided direct thermal printer of claim 49, wherein the select thermal printing mode command comprises one of a 1F 60 00, a 1F 60 01, a 1F 60 02, and a 1F 60 03 hexadecimal command directing operation of the dual-sided direct thermal printer in the single-sided printing mode, the double-sided with single-side command mode, the double-sided with double-side command mode, and the double-sided with predefined data command mode, respectively.

51. The dual-sided direct thermal printer of claim 49, wherein the communication controller is further configured to receive print data.

52. The dual-sided direct thermal printer of claim 49, wherein the printing function switch is further configured to default to operating the dual-sided direct thermal printer in the single-sided printing mode.

* * * * *